US005879093A

United States Patent [19]

Ohba et al.

[11] Patent Number: 5,879,093

[45] Date of Patent: Mar. 9, 1999

[54] MECHANISM FOR FEEDING STICK TYPE COSMETIC MATERIALS, CONTAINER EMPLOYING THE SAME AND CARTRIDGE EMPLOYED THEREIN

[75] Inventors: Atsushi Ohba; Yutaka Yamazaki, both of Tokyo, Japan

[73] Assignees: Suzuno Kasei Co., Ltd; Kabushiki Kaisha Suzuno Enterprise, both of Tokyo, Japan

[21] Appl. No.: 826,320

[22] Filed: Mar. 27, 1997

Related U.S. Application Data

[62] Division of Ser. No. 647,148, May 9, 1996, abandoned, which is a continuation of Ser. No. 153,697, Nov. 17, 1993, abandoned.

[30] Foreign Application Priority Data

| | | | |
|---|---|---|---|
| Nov. 24, 1992 | [JP] | Japan | 4-334991 |
| Dec. 28, 1992 | [JP] | Japan | 4-92953 |
| May 21, 1993 | [JP] | Japan | 5-141214 |
| Aug. 2, 1993 | [JP] | Japan | 5-208163 |

[51] Int. Cl.[6] ..... A45D 40/06; A45D 40/10; A45D 40/20

[52] U.S. Cl. ..... 401/68; 401/75; 401/79; 401/87

[58] Field of Search ..... 401/68, 75, 76, 401/172, 174, 54, 62, 87, 79

[56] References Cited

U.S. PATENT DOCUMENTS

| | | | |
|---|---|---|---|
| 873,769 | 12/1907 | Morris | 401/174 |
| 1,583,718 | 5/1926 | Hudson | 401/62 |
| 2,700,371 | 1/1955 | Zahel | 401/75 |
| 3,002,517 | 10/1961 | Pitton | 401/172 |
| 3,275,132 | 9/1966 | Hultgren | 401/76 X |
| 3,333,689 | 8/1967 | Terrill et al. | 401/76 |

FOREIGN PATENT DOCUMENTS

| | | | |
|---|---|---|---|
| 13629 | 10/1887 | Br. Indian Ocean Ter. | 401/62 |
| 195755 | 4/1923 | Br. Indian Ocean Ter. | 401/75 |
| 2026983 | 2/1980 | Br. Indian Ocean Ter. | 401/68 |
| 1173694 | 2/1959 | France | 401/174 |
| 835853 | 4/1952 | Germany | 401/174 |
| 589535 | 2/1983 | Japan | 401/79 |
| 331231 | 7/1991 | Japan | 401/79 |

*Primary Examiner*—Steven A. Bratlie
*Attorney, Agent, or Firm*—Jordan and Hamburg LLP

[57] ABSTRACT

A mechanism for feeding a core material such as a stick type cosmetic material includes an internal thread member having a spirally grooved inner surface and a push rod provided with a group of protrusions which engage with the spiral groove of the internal thread member; wherein the push rod is advanced or retracted by turning the internal thread member and the push rod engaged therewith relative to each other to feed the core material housed in a container to be slidably moved the push rod. Since the protrusions on the surface of the push rod can be of a simple shape, the push rod can be produced easily, and this effect manifests particularly in a comparison with the case where a thread must be formed on the push rod over the entire length thereof, requiring laborious thread machining or die making. Depending on the grouping (selection) of the protrusions provided on the outer surface of the push rod so as to occupy partially at strategic positions an imaginary continuous spiral space, the pitch, lead and direction of torsion of the resulting "screw" can arbitrarily be selected within a certain range. Further, since the push rod itself has a spiral function, the diameter of the push rod and that of the main body of the container can be reduced.

3 Claims, 28 Drawing Sheets

MECHANISM FOR FEEDING STICK TYPE COSMETIC MATERIALS, CONTAINER EMPLOYING THE SAME AND CARTRIDGE EMPLOYED THEREIN

This application is a division of application Ser. No. 08/647,148 filed May 9, 1996, which is a continuation of Ser. No. 08/153,697 filed Nov. 17, 1993 both abandoned.

BACKGROUND OF THE INVENTION

This invention relates to a mechanism for feeding a stick type cosmetic material (lipstick, eye liner, etc.), etc. and to a container employing the same. More specifically, this invention relates to a mechanism for feeding a stick type cosmetic material utilizing a push rod having a group of protrusions which function as an external thread and, as necessary, rotation-stop ribs, which has a simple structure and can be produced easily, as well as, to a container for feeding a stick type cosmetic material, etc., utilizing such mechanism.

Examples of prior art mechanism and container for feeding a stick type cosmetic material will now be described. Containers for feeding stick type cosmetic materials include those of cartridge type and non-cartridge type. In the cartridge type container, cartridges respectively containing different colors of core materials (hereinafter referred to as stick type cosmetic materials) are provided, and a user selects and replace the desired cartridge and sets it in the body of the container.

FIG. 12 shows in cross-section the structure of the body of a prior art cartridge type container disclosed in Japanese Utility Model Publication No. 50814/1991. In a main body 200 are housed a push rod 201 and an inner barrel 207. The push rod 201 is provided on the circumference at the rear end portion thereof with an external thread 205, while the rest of the portion on the circumference of the push rod 201 is provided with elongated ridges 206. Meanwhile, the inner circumference of the inner barrel 207 is provided over the entire length thereof with an internal thread 209 which is engaged with the external thread 205. The inner barrel 207 is also provided with elongated ridges 213 on the outer surface thereof, which engage with grooves 211 formed on the inner surface of an outer barrel 215.

After a cartridge is inserted through the tip opening 217 of the outer barrel 215 of the main body 200 and the rotation-stop section of the cartridge and the elongated ridges 206 of the push rod 201 are engaged, the cartridge and the main body 200 are turned relative to each other (e.g. one is immobilized, and the other is turned), whereby the push rod 201 can be advanced or retracted in the axial direction. On the other hand, in a non-cartridge type container, the stick type cosmetic material is inserted to a chuck provided at the tip of the push rod 201, and the push rod 201 (external thread 205) and the inner barrel 207 (internal thread 209) are turned relative to each other using some means, for example, a cylinder disposed around the stick type cosmetic material which is designed to be engaged with the elongated ridges 206 of the push rod 201. In any case, the push rod 201 is designed to be advanced or retracted in the axial direction of the main body to allow the stick type cosmetic material to be fed out or retracted.

In the prior art feeding mechanisms, the external thread and the rotation-stop section (ribs etc.) formed on the push rod, and the internal thread formed in the main body are essential elements. Accordingly, a complicated design or working has been required so as to form these elements into respective parts. For example, the feeding mechanism disclosed in Japanese Utility Model Publication No. 50814/1991 (FIG. 12) involves the following problems.

(1) Since the internal thread 209 of the inner barrel 207 is long, molding and working take much time and labor;

(2) The diameter of the internal thread 209 cannot be reduced due to the limitation in molding and working thereof (e.g. strength of injection molding core pin and working thereof), so that the diameter of the container itself cannot be reduced;

(3) If the push rod 201 is provided on the outer circumference substantially over the entire length thereof with the external thread, the length of the internal thread to be engaged therewith can be short. However, elongated ridges or grooves as a rotation-stop mechanism must be provided on the surface of the external thread of the push rod, inevitably making the shape of the push rod complicated, as shown in FIG. 13. In FIG. 13, a push rod 305 is provided on the circumference with an external thread substantially over the entire length thereof, and ribs 321 are provided at the crest of the external thread 323. The external thread 323 is engaged with the internal thread 311 of the main body 301, while the ribs 321 are engaged with the engagement grooves 351 formed in the cartridge 341, whereby the cartridge and the push rod can be turned synchronously. Contrary to the constitution shown in FIG. 13, grooves may be formed on the crest of the external thread of the push rod, and ribs may be formed in the cartridge; and (4) If a push rod having an external thread formed on the outer circumference thereof is to be formed by injection molding using a split mold, there are strict limitations on the diameter and the pitch of the thread so as to prevent undercut which is liable to occur in mold releasing, and thus the resulting thread inevitably comes to have a short pitch, giving rise to a problem in the operability of the feeding mechanism.

SUMMARY OF THE INVENTION

Therefore, it is an object of the invention to provide a feeding mechanism which has a simple structure and a reduced diameter and can be produced easily, as well as, a container for a stick type cosmetic material etc. employing the same.

In order to overcome the above problems, the mechanism for feeding a stick type cosmetic material etc. according to this invention comprises an internal thread member having a spirally grooved inner surface and a push rod provided with a group of protrusions which engage with the spiral groove of the internal thread member; wherein the push rod is advanced or retracted by turning the internal thread member and the push rod engaged therewith relative to each other to feed the stick type cosmetic material etc. housed in a container to be slidably moving with the push rod. Incidentally, it is needless to say that the feeding mechanism according to this invention can be employed as the mechanism for feeding materials other than the stick type cosmetic material, and this mechanism can be used nonlimitatively and widely as a feeding mechanism in general machinery. The internal thread member itself need not constitute a single part and can be formed at some portion of other parts (internal thread section ). The same shall apply to grooved member etc. to be described later.

The container for feeding a stick type cosmetic material according to this invention comprises a pair of barrels connected in the axial direction to be rotatable relative to each other; a push rod housed in these barrels to be movable in the axial direction; a chuck, for retaining the stick type cosmetic material, which moves with the push rod; and an internal thread member, having a spirally grooved internal surface, which rotates synchronously with one of the barrels (first barrel); wherein the push rod is provided on the outer surface thereof with a group of protrusions which are engaged with the spiral groove of the internal thread member; the push rod rotates synchronously with the other barrel (second barrel); whereby the push rod can be advanced or retracted by turning the two barrels relative to each other to turn the internal thread member and the push rod relative to each other.

The cartridge type container for feeding a stick type cosmetic material according to this invention comprises a barrel-like main body having a push rod housed therein to be able to move in the axial direction and a cartridge, attached to the front end portion of the main body, which can feed the stick type cosmetic material moving with the movement of the push rod; characterized in that the container has an internal thread member having a spirally grooved inner surface, and the push rod is provided with a group of protrusions which are engaged with the spiral groove of the internal thread member; wherein the internal thread member can be turned synchronously with one of the main body and the cartridge, while the push rod can be turned synchronously with the other of the cartridge and the main body; whereby the push rod can be advanced or retracted by turning the main body and the cartridge relative to each other under engagement.

The feeding mechanism of the invention may further be equipped, in addition to the internal thread member and push rod, a grooved member having a groove, which is engaged with the group of protrusions, defined in the manner different from that of the spiral groove of the internal thread member; whereby the push rod can be advanced or retracted by turning the internal thread member and the grooved member relative to each other.

In an embodiment where the feeding mechanism of the invention is applied to a cartridge type container, the stick type cosmetic material etc. is housed in a cartridge cylinder in which the grooved member is disposed; the internal thread member is disposed in the barrel of the main body of the container; and the cartridge cylinder and the barrel are designed to be removable relative to each other; whereby the push rod can be advanced or retracted by turning the cartridge cylinder and the barrel relative to each other under engagement.

The action of the feeding mechanism of the invention in operation will now be described. The spiral groove formed on the inner surface of the internal thread member is engaged with the group of protrusions provided on the outer surface of the push rod, and the protrusions successively proceed (advance) spirally along the spiral groove by turning the push rod (or by turning the internal thread member), whereby the push rod is allowed to advance rotating in the axial direction. If the push rod is turned in the opposite direction, the push rod is allowed to move in the opposite direction (retract) in the axial direction. Thus, the push rod can be advanced or retracted. The stick type cosmetic material is interlocked or moved with the push rod. For example, the cosmetic material is fixed on the tip of the push rod, or it is abutted against the tip of the push rod and urged by a spring to be brought into intimate contact therewith, so that it can be fed out or retracted by advancing or retracting the push rod. Otherwise, the push rod may be of so-called one-way type in which the push rod is designed only to feed out the stick type cosmetic material, and the user pushes the stick type cosmetic material back into the container.

In order to allow the push rod to achieve such action, the group of protrusions are preferably arranged to occupy partially an imaginary spiral space which is engageable with the spiral grooves. For example, the group of protrusions are preferably arranged linearly in the axial direction of the push rod at such a pitch that corresponds to a multiplication of the pitch of the spiral groove by an integer. The reason is that the protrusions can be prevented from interfering with the wall of the spiral groove, and that the push rod can be designed and produced easily. While the integer referred to herein generally includes 1, where the pitch of the row of the protrusions arranged in the axial direction is equal to that of the spiral groove, it may of course be 2, 3, 4 . . . (the protrusions come to be arranged sparser).

In the conventional screw type feeding mechanism, a thread having a certain cross-sectional profile is formed continuously, because it has been considered to be a matter of course based on the general conception of the screw and because of the limitations in producing screws by machining. However, on second thoughts, a thread having a certain cross-sectional profile need not be formed continuously in most feeding mechanisms. A group of protrusions having a suitable form which are arranged intermittently at strategic positions along such imaginary continuous screw may be used as the "screw". In such cases, the pitch, lead and direction of torsion of such screw can arbitrarily be selected within a certain range depending on the grouping (selection) of the protrusions. If a group of protrusions arranged linearly in the axial direction is selected, it constitutes a screw having an infinite lead (spline).

The action of the feeding mechanism additionally having the grooved member will now be described. The grooves of the grooved member engage with the group of protrusions provided on the outer surface of the push rod in the manner different from that of the spiral groove of the internal thread member. For example, the protrusions are arranged linearly in the axial direction of the push rod, while the grooved member has linear grooves, and the linear rows of protrusions arranged on the push rod engage with the linear grooves of the grooved member (the protrusions can advance straight along the linear grooves). In such structure, the grooved member and the push rod turn synchronously, and when the grooved member is stopped turning, the protrusions of the push rod are constricted in the linear grooves of the grooved member to prevent the push rod from turning (but not to prevent straight advancement thereof). If the internal thread member is turned in this state, the protrusions on the push rod are pushed by the side wall of the spiral groove to allow the push rod to advance or retract in the axial direction. The push rod can also be advanced or retracted by stopping turning of the internal thread member and turning the grooved member.

The grooves of the grooved member must be formed in the manner different from that of the spiral grooves of the internal thread member. For example, the grooves of the grooved member may be spiral grooves having a pitch different from that of the spiral groove of the internal thread member or an opposite direction of torsion.

The container for a stick type cosmetic material etc. employing the feeding mechanism according to one embodiment of the invention comprises a pair of barrels connected in the axial direction to be rotatable relative to each other; a push rod housed in the barrels to be movable in the axial direction; and a chuck, for retaining the stick type cosmetic material and the like, which moves with the push rod; wherein one of the barrels (first barrel) is provided therein with an internal thread member having a spirally grooved inner surface; the other barrel (second barrel) is provided with a grooved member which is grooved according to a manner different from that of the spiral groove of the internal thread member; the push rod is provided on the outer surface thereof with a group of protrusions which engage with the spiral groove of the internal thread member and also with the grooves of the grooved member; whereby the push rod can be advanced or retracted by turning the two barrels relative to each other to turn the internal thread member and grooved member relative to each other.

The cartridge type container for feeding a core material such as a stick type cosmetic material according to another embodiment of the invention comprises a main body including a barrel and a push rod housed therein to be able to move in the axial direction, and a cartridge including a cartridge cylinder and a chuck, housed slidably therein, for retaining the core material, which is removably attached to the front end portion of the main body so as to feed the core material moving with the movement of the push rod; wherein the feeding container further comprises an internal thread member having a spirally grooved inner surface which can unrotatably be engaged either with the main body or the cartridge under attachment of the cartridge to the main body and also a grooved member, having grooves formed in the manner different from that of the spiral groove, which can unrotatably be engaged either with the cartridge or with the main body; the push rod being provided on the outer surface with a group of protrusions which are engaged with the spiral groove of the internal thread member and also with the grooves of the grooved member; whereby the push rod can be advanced or retracted in the cartridge cylinder by turning the cartridge and the main body relative to each other under engagement.

The container for feeding a stick type cosmetic material according to still another embodiment of the invention comprises a main body having a push rod housed therein to be able to move in the axial direction, and a cartridge attached removably to the front end portion of the main body and containing a stick type cosmetic material to be slidable in the axial direction; wherein the main body comprises the push rod provided with a group of protrusions arranged to occupy partly the space of an imaginary screw assumed to exist spirally along the outer surface of the push rod and at the same time linearly the axial direction, a barrel having the push rod housed therein, provided at the front end with a rotation-stop section which can be engaged with the group of protrusions of the push rod slidably in the axial direction but unrotatably, an internal thread member having a spiral groove which can be engaged with the group of protrusions of the push rod, and attached rotatably via the push rod to the front end portion of the barrel, and a stopper, for stopping slipping off of the internal thread member from the push rod, attached to the front end portion of the push rod; while the cartridge comprises a hollow cartridge cylinder, a chuck, for retaining the stick type cosmetic material, disposed slidably in the cartridge cylinder and a spring for urging the chuck backward; the internal thread member and the cartridge cylinder being provided respectively with synchronously engageable sections for engaging these two members to be able to rotate synchronously under engagement of the cartridge with the main body; whereby the push rod can be advanced or retracted in the cartridge cylinder by turning the barrel and the cartridge cylinder relative to each other. Incidentally, in a stick type cosmetic material feeding container analogous to this embodiment, the positional relationship between the rotation-stop section and the internal thread member is reversed.

The group of protrusions provided on the push rod and the grooves of the rotation-stop section are engaged with each other slidably in the axial direction but unrotatably. The term "unrotatably" used herein means that the push rod and the rotation-stop section (or member) can be turned substantially synchronously. For example, the protrusions of the push rod can advance straight in the axial direction along the vertical grooves formed on the inner surface of the rotation-stop section straight in the axial direction. It should be noted here that the vertical grooves may be formed slightly spirally, provided that the relative rotation of the push rod and the internal screw thread member is not prevented. Further, there may be a small degree of backlash or play in the engaging section, and rotation within such backlash or play is allowable.

The internal thread member and the cartridge cylinder, or the rotation-stop member and the cartridge cylinder of the above embodiment are engaged with each other so that they may be able to turn synchronously when the cartridge is inserted to the main body. The engagement means may typically be a circumferential or axial ridge-and-recess engagement or a frictional member (O-ring) and the like.

In the mechanism or container for feeding a stick type cosmetic material according to this invention, the push rod is additionally provided therein with stopper protrusions which do not engage with the spiral groove of the internal thread member but interfere therewith to serve as the stopper for the push rod and define the advanced extremity or retracted extremity (stroke end) thereof.

In the mechanism or container for feeding a core material such as a stick type cosmetic material according to this invention, the push rod has on the outer surface thereof a cylindrical flat portion where no protrusions exist, and the flat portion makes an idling rotation in the internal thread member or in the grooved member to make the push rod to be incapable of advancing or retracting at the corresponding portion. For example, if the push rod is designed to make an idling rotation at the front stroke end or advanced extremity, the user can know that the cosmetic material is used up.

The container for feeding a stick type cosmetic material according to another embodiment of the invention comprises a main body having a push rod housed therein to be able to move in the axial direction and a cartridge attached removably to the front end of the main body and containing a stick type cosmetic material to be slidable in the axial direction; wherein the main body comprises a barrel having an elongated streak formed on the inner surface thereof, a push rod, disposed in the barrel, provided with an engagement section at the rear end portion thereof to be engageable with the elongated streak of the barrel slidably in the axial direction but unrotatably and also with a spiral body formed on the outer surface thereof and an internal thread member having a spiral groove which can be engaged with the spiral body of the push rod; while the cartridge comprises a hollow cartridge cylinder and a chuck, for retaining the stick type cosmetic material, disposed slidably in the cartridge cylinder; the internal thread member and the cartridge cylinder being provided respectively with synchronously engageable sections so that they can be rotated synchronously under engagement of the cartridge with the main body; the spiral body provided on the outer surface of the push rod consists of a group of protrusions arranged to occupy partly an imaginary spiral space assumed to exist on the outer surface thereof which engages with the spiral groove of the internal thread member; whereby the push rod can be advanced or retracted in the cartridge cylinder by turning the barrel and the cartridge cylinder relative to each other.

The action of the container according to this embodiment will now be described. A spiral body (external thread and the like) is formed on the outer surface of the push rod. The spiral body is engaged with the spiral groove of the internal thread member. Accordingly, when the push rod and the internal thread member are turned relative to each other in this state, the push rod is fed out (or retracted) from the internal thread member. In this invention, the push rod is designed to be turned synchronously with the main body, and, the internal thread member is designed to be turned synchronously with the cartridge, respectively, so that the main body and the cartridge are turned relative to each other to allow the push rod to be advanced or retracted. Thus, the stick type cosmetic material supported on the chuck housed slidably in the cartridge cylinder can be advanced or retracted through the tip opening of the cartridge cylinder.

The push rod and the main body are engaged with each other by the elongated engagement streak (e.g. vertical grooves) formed on the inner surface of the barrel of the main body, and by the rear end engagement section (e.g. protrusion, butt) of the push rod engageable with the streak slidably in the axial direction but unrotatably. The term "unrotatably" used herein means that the push rod and the main body can be turned substantially synchronously, as described before.

The internal thread member and the cartridge cylinder are engaged in such a way that they can be turned synchronously when the cartridge is inserted to the main body of the container. Typical engagement means include, for example, a circumferential or axial ridge-and-recess engagement and a frictional member (O-ring, etc.).

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

PREFERRED EMBODIMENTS OF THE INVENTION

Figure 1:
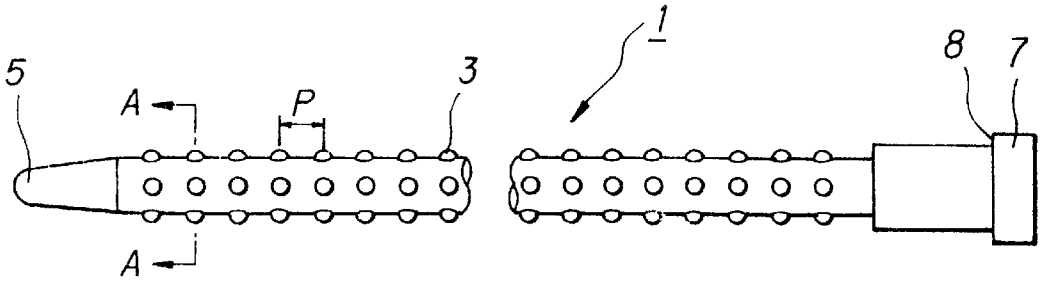
FIG. 1 shows one embodiment of the push rod employed in the feeding mechanism according to this invention.
Figure 2:
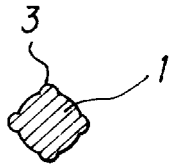
FIG. 2 shows a cross-sectional view of the push rod taken along the line A—A of FIG. 1.

The feeding mechanism and container according to preferred embodiments of the invention will be described below referring to the attached drawings. FIG. 1 shows one embodiment of the push rod employed in the feeding mechanism according to this invention. FIG. 2 shows a cross-sectional view of the push rod taken along the line A—A of FIG. 1. A push rod 1 is provided with a group of protrusions 3 on the outer surface. In this embodiment, the protrusions 3 are arranged linearly in four rows in the axial direction thereof at a pitch P with an angle of 90° between the rows in the circumferential direction. While the protrusions 3 each have a semispherical shape in this embodiment, they may be of other shapes such as tetrahedral, pyramidal and conical shapes or truncated tetrahedral, pyramidal and conical shapes, or triangular, square, polygonal, circular and ellipsoidal columns. The tip 5 of the push rod 1 is a portion for pushing (or pulling) a stick type cosmetic material and the like, and the face 8 of a rear end flange 7 is abutted against the end of an internal thread member (to be described later) to define a stroke end and also serves as a face on which one end portion of a return spring is retained. The shape of the tip 5 or the rear end flange 7 may not be limited to this embodiment, and a chuck for holding the stick type cosmetic material may be formed at the tip 5. The cross-sectional profile of the main body of the push rod 1 may not be limited to the circular shape, and it may be of a suitable polygonal shape, etc.

Figure 3:
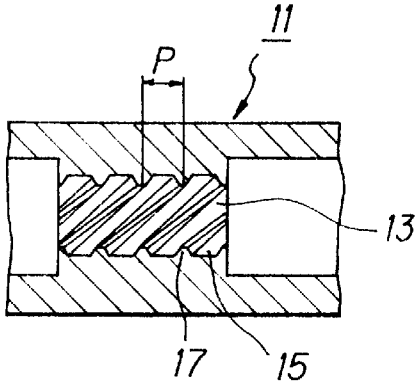
FIG. 3 shows a cross-sectional view of the internal thread member having spiral grooves which are engageable with the group of protrusions provided on the push rod.

FIG. 3 shows a cross-sectional view of the internal thread member having spiral grooves which are engageable with a group of protrusions 3 provided on the push rod 1 shown in FIG. 1. The internal thread member 11 has spiral grooves 15 (four in this embodiment) formed on the inner surface 13 thereof. While the number of grooves may not be limited, the groove may advantageously be formed in plural numbers so that the length of the internal thread member 11 can be reduced. While the cross-sectional profiles of the spiral grooves 15 and of the spiral thread 17 are trapezoidal in this embodiment, they may be of other shapes such as of sine curve, arc, triangle, square, etc. The length of the portion of the internal thread member 11 where the spiral grooves 15 are formed has a length such that it can always be engaged with at least one protrusion 3 of the push rod 1. However, the spiral grooves 15 are preferably engaged constantly with several protrusions 3 so as to secure strength and smooth movement of the mechanism.

Figure 4A:
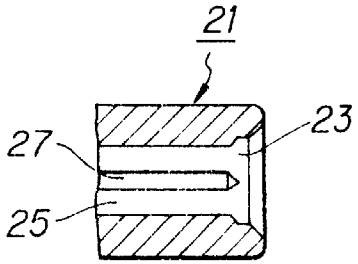
FIGS. 4A and 4B show a cross-sectional view and an end view of the grooved member having engagement grooves which are engageable with the group of protrusions provided on the push rod.
Figure 4B:
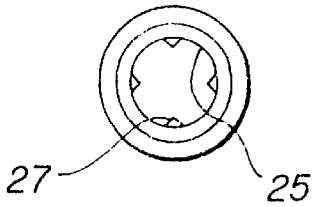

FIG. 4 shows a cross-sectional view of the grooved member having engagement grooves which are engageable with a group of protrusions provided on the push rod. Four linear engagement grooves 25 are formed on the inner surface 23 of a grooved member 21. These engagement grooves 25 are defined by elongated ridges 27. The linear rows of protrusions 3 of the push rod 1 directly proceed straight along these engagement grooves 25. In this state, the grooved member 21 and the push rod 1 cannot be turned relative to each other (they turn synchronously). When the grooved member 21 is immobilized and the internal thread member 11 is turned once, the push rod 1 is advanced or retracted by one lead (4 pitches) of the spiral grooves 25. The push rod 1 can likewise be advanced or retracted by immobilizing the internal thread member 11 and turning the grooved member 21.

The engagement grooves 25 of the grooved member 21 may not critically be linear. The essential point is that the grooves 25 can receive all of the protrusions 3 provided on the circumference of the push rod 1 with no interference between the groove walls (ridges 27 formed between the grooves 25) and the protrusions 3 of the push rod 1. For example, the engagement grooves 25 may be defined spirally at a lead twice as much as that of the spiral grooves 15 of the internal thread member 11. In this case, when the grooved member 21 is immobilized and the internal thread member 11 is turned once, the push rod 1 is advanced or retracted by a ½ lead of the spiral grooves 15 of the internal thread member 11. From the standpoint of producing the grooved member, linear grooves are easier to form.

While the material of the push rod, the internal thread member and the grooved member in this embodiment, and the processes for producing them may not particularly be limited, molding (using a split mold) is suitably employed for forming the push rod. Since the protrusions to be provided on the outer surface of the push rod may be of a simple shape and thus there is no fear of the occurrence of undercutting, the push rod can easily be designed and produced. These parts, when used in the stick type cosmetic material container, are preferably made by injection molding using a plastic material.

Figure 5:
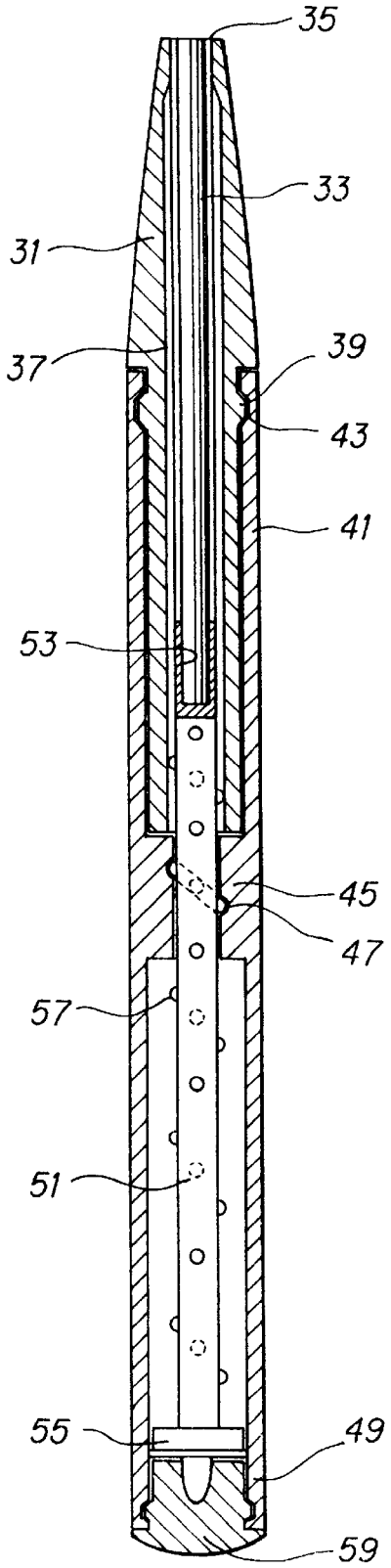
FIG. 5 shows a cross-sectional view of one embodiment of the container for feeding a stick type cosmetic material employing the feeding mechanism of the invention.

FIG. 5 shows a cross-sectional view of one embodiment of the container for feeding a stick type cosmetic material employing the feeding mechanism of the invention. A stick type cosmetic material 33 is placed in a front barrel 31 in such a way that it can be moved in the axial direction (vertically in FIG. 5). The rear end portion (lower end portion in FIG. 5) of the stick type cosmetic material 33 is fitted and retained in a cavity 53 provided at the tip of a push rod 51.

Linear engagement grooves 37 are defined axially on the inner surface of the front barrel 31, and the front barrel 31 serves also as the grooved member of the feeding mechanism. A main barrel 41 is fitted coaxially and rotatably on the front barrel 31. An internal thread section 45 is integrally formed in the main barrel 41, which serves as the internal thread member of the feeding mechanism. A spiral groove 47 is formed on the inner surface of the internal thread section 45 with which protrusions 57 of the push rod 51 are engaged. A rotatable engagement section consisting of an annular ridge 39 and an annular recess 43 is provided at the joint of the main barrel 41 and the front barrel 31, so that the front barrel 31 may not easily slip out. As such engagement means, leaf springs, an O-ring or various types of ridge-and-recess engagements can be employed instead. A plug 59 is fitted to the rear end portion 49 of the main barrel 41 and abutted against the lower surface of a rear end flange 55 of the push rod 51 to define the stroke end of the push rod 51 on the rear end side.

The protrusions 57 are arranged in four rows on the outer surface of the push rod 51 at a predetermined pitch. The protrusions 57 in one row are provided apart from those in the adjacent row by 90° in the circumferential direction and staggered in the axial direction by a ¼ pitch. The action of the container will now be described. For example, when a user holds the main barrel 41 between the fingers of the left hand and turns the front barrel 31 with the fingers of the right hand, the push rod 51 is turned synchronously with the front barrel 31 (for the protrusions 57 of the push rod 51 are intruded into the engagement grooves 37 of the front barrel 31). Accordingly, the protrusions 57 of the push rod 51 engaging with the spiral grooves 47 of the internal thread section 45 move in the axial direction turning along the spiral groove 47, and thus the push rod 51 can be advanced or retracted. The stick type cosmetic material 33 can also be fed or retracted interlocking with the axial movement of the push rod 51.

Figure 6:
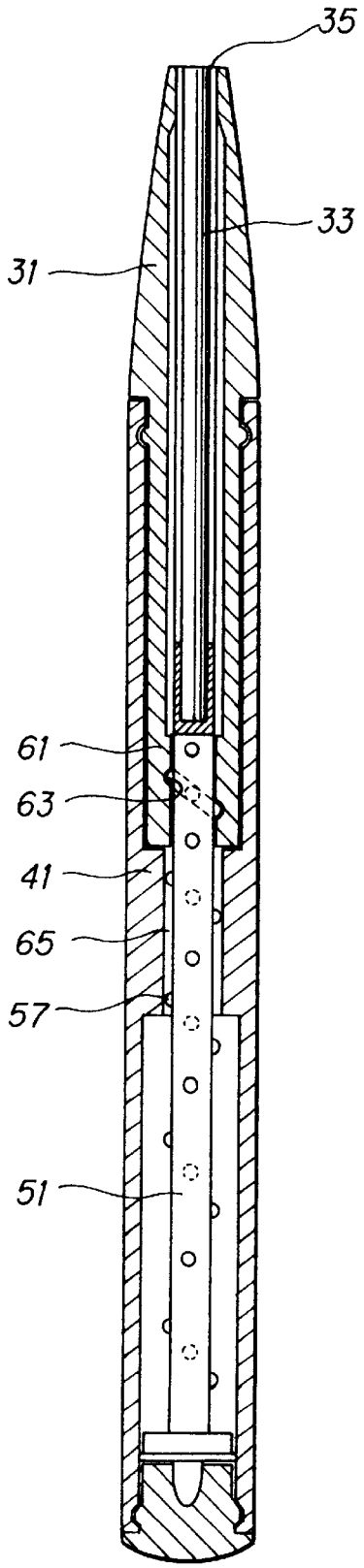
FIG. 6 shows a cross-sectional view of another embodiment of the container for feeding a stick type cosmetic material employing the feeding mechanism of the invention.

FIG. 6 shows a cross-sectional view of another embodiment of the container for feeding a stick type cosmetic material employing the feeding mechanism of the invention. In the container of this embodiment, contrary to that shown in FIG. 5, an internal thread section 61 is provided in the front barrel 31, and engagement grooves 65 are defined in a main barrel 41. This constitution can also achieve the feeding action in the same manner as described above. However, the difference is that, in the case of the container shown in FIG. 5, since the stick type cosmetic material 33 and the front barrel 31 are designed to be turned synchronously, the stick type cosmetic material 33 can be fed straight in and out of the tip opening 35 of the front barrel 31, but in the case of the container shown in FIG. 6, the stick type cosmetic material 33 is fed in and out of the tip opening 35 while turning. Incidentally, as a rotation-stop mechanism between the main barrel 41 and the push rod 51, there may be provided ridges or protrusions on the rear end (bottom) flange of the push rod 51 and axial grooves on the inner surface of the main barrel 41, and they can be engaged.

Figure 7:
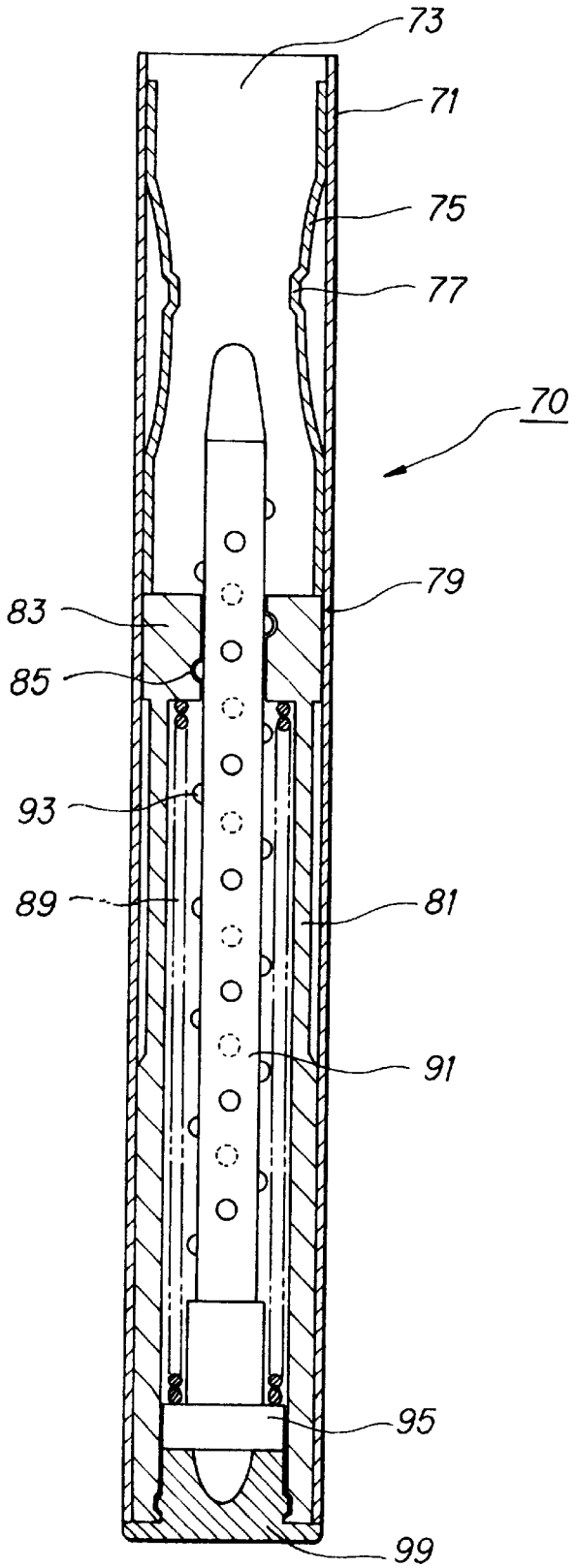
FIG. 7 shows a cross-sectional view of the main body of a cartridge type container for feeding a stick type cosmetic material according to one embodiment of the invention.
Figure 12:
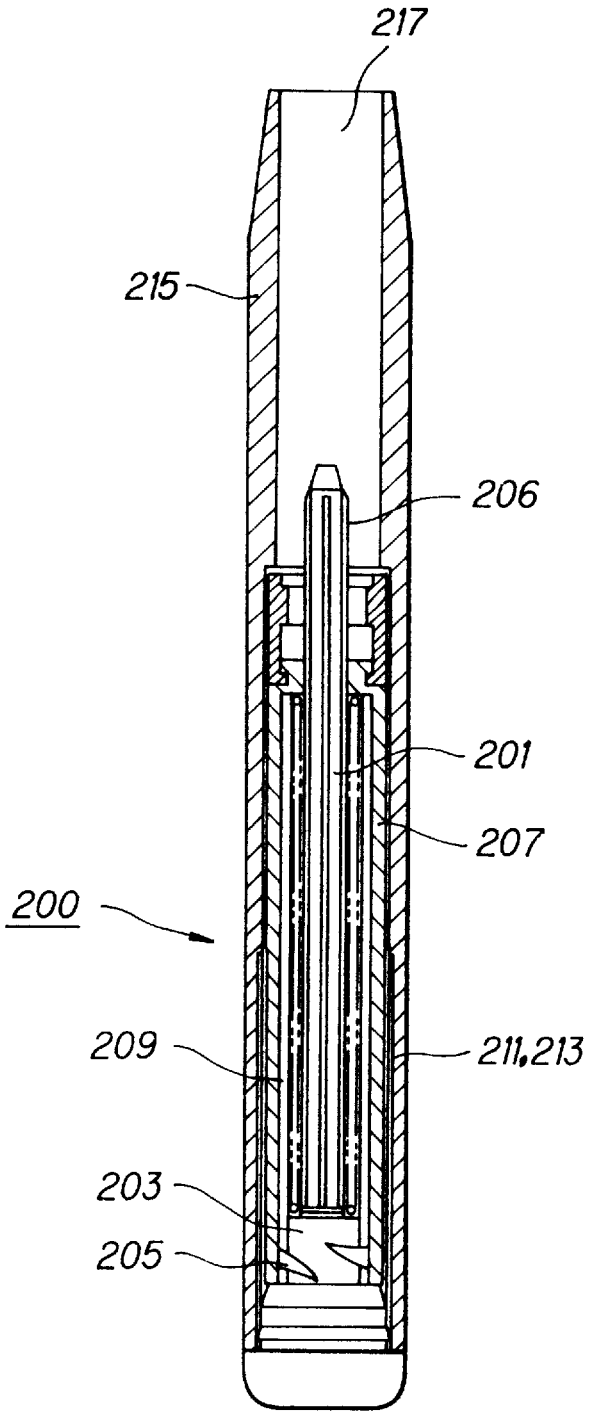
FIG. 12 PRIOR ART
FIG. 12 shows a cross section of the main body of prior art cartridge type container disclosed in Japanese Utility Model Publication No. 50814/1991.
Figure 13:
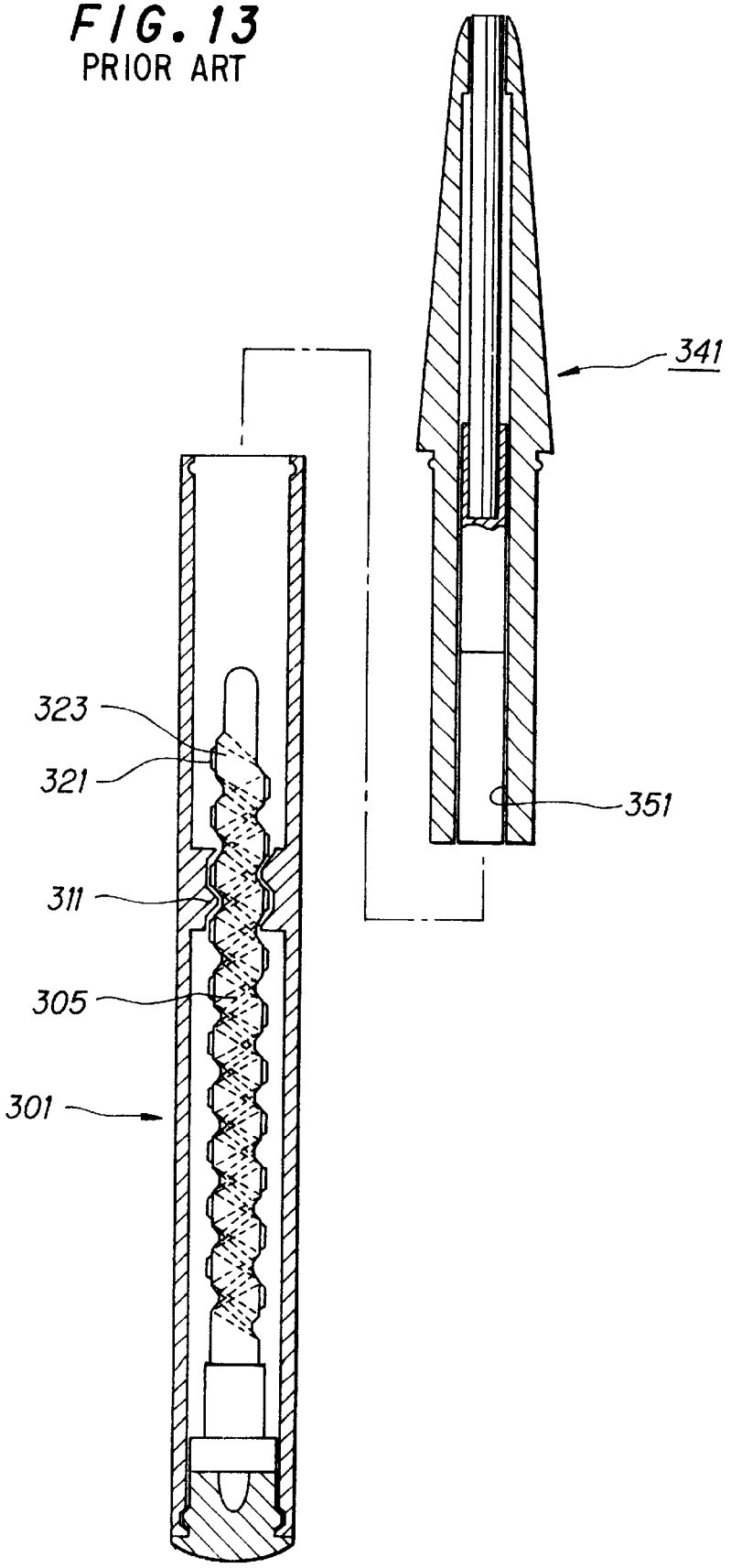
FIG. 13 PRIOR ART
FIG. 13 shows a cross-sectional view of the feeding mechanism incorporated also as a comparative example.

FIG. 7 shows a cross-sectional view of the main body of the cartridge type container for feeding a stick type cosmetic material according to one embodiment of the invention. In this embodiment, an internal thread section 83 is formed on the inner surface of an inner barrel 81 housed in a main body 70. The inner barrel 81 is housed in an outer barrel 71, and they are engaged with each other at a fit drive section 79 (ridge and recess and the like) so as to be able to turn integrally. The outer barrel 71 may be made of a thin metal so as to attach ornamental quality to the container. The internal thread section 83 of the inner barrel 81 may be formed partly on the inner surface thereof (only one round is sufficient). In this respect, this embodiment is greatly different from the prior art container, shown in FIG. 12, in which an internal thread 209 is formed on the inner surface of the inner barrel 207 over the entire length thereof. It takes time or labor to form an elongated internal thread either by injection molding or by machining, and thus it is unproductive. Since protrusions 93, which engage with the spiral groove 85, is formed substantially over the entire length of a push rod 91 in this embodiment, the internal thread section 83 engaged with the protrusions 93 need not be as long as the stroke of the push rod 91 and may have a minimum length which ensure engagement with some of the group of protrusions 93, and thus the inner barrel can easily be produced.

In this embodiment, a spring 89 is incorporated in the main body 70, while winding the push rod 91, and urges the push rod 91 backward. The spring 89 is retained between the lower end face of the internal thread section 83 of the inner barrel 81 and the upper end face of the flange 95 of the push rod 91. The spring 89 urges to push the push rod 91 downward in FIG. 7. A plug 99 is fitted to the lower end portion of the inner barrel 81 and that of the outer barrel 71 to define the rear extremity (lowermost position) of the push rod 91. Due to the presence of the spring 89, the push rod 91 is forced to return spontaneously to the retracted extremity from the feeding position while turning, when the push rod 91 is allowed to turn freely. Accordingly, the push rod 91 is retracted to the retracted extremity whenever the cartridge is detached for replacement, so that it never happens that the stick type cosmetic material is fed out inadvertently when a new cartridge is inserted. Thus, damage of the stick type cosmetic material can be prevented.

Leaf springs 75 are attached to the inner surface in the opening 73 of the main body 70 of the container in this embodiment. The leaf springs 75 press the shaft 106 of a cartridge cylinder 103 shown in FIG. 8 to securely hold the cartridge cylinder 103 in position and also provide an appropriate rotational resistance between the main body 70 and the cartridge 101. The leaf springs 75 are each provided with a ridge 77 which engages with the recess 107 formed on the shaft 106 of the cartridge 101 to serve as a slip stopper for the cartridge 101. Further, the clicking and the touch which occur when the ridges 77 and the recess 107 are engaged make the user know that the insertion of the cartridge is completed and have an agreeable feeling. The relationship between the ridges and recess used in this embodiment may be reversed.

Figure 8:
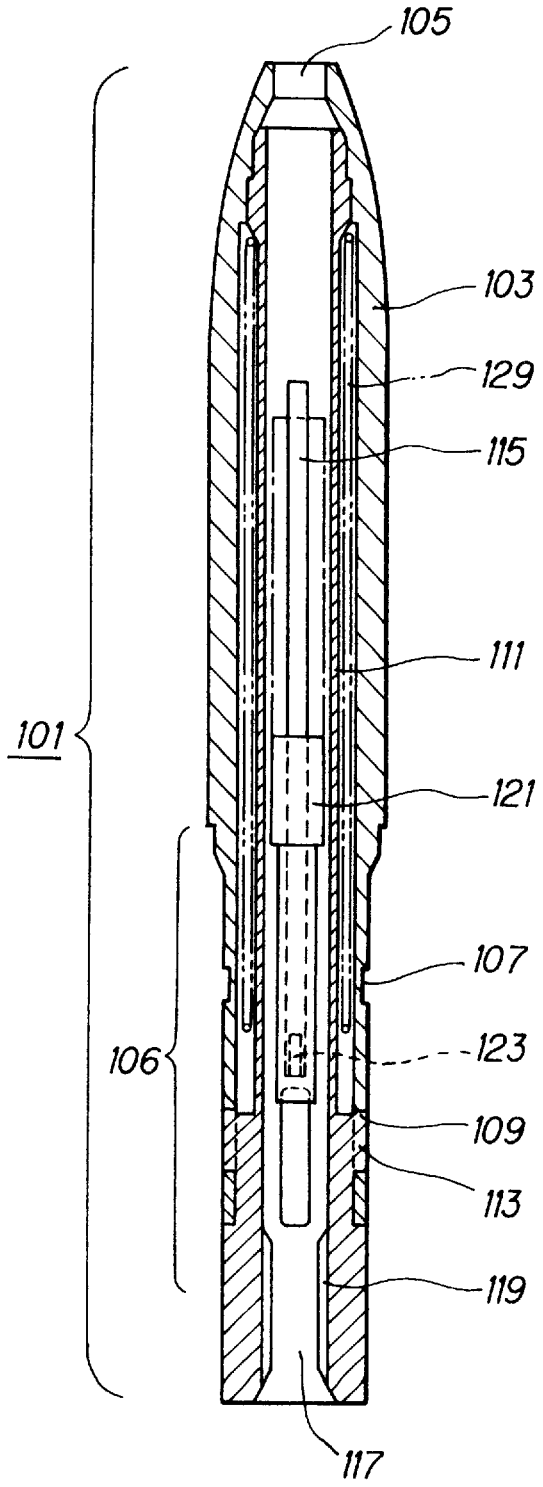
FIG. 8 shows a cross-sectional view of the cartridge to be inserted to the main body of the container shown in FIG. 7.

FIG. 8 shows a cross-sectional view of the cartridge 101 to be inserted to the main body 70 of the container shown in FIG. 7. The cartridge cylinder 103 has a tip opening 105 for feeding in and out a stick type cosmetic material (not shown), and a slitted shaft 111 is disposed therein. A pair of engagement holes 109 are defined at the rear end portion (lower position in FIG. 8) of the cartridge cylinder 103, in which bosses 113 of the slitted shaft 111 are engaged. Accordingly, the slitted shaft 111 and the cartridge cylinder 103 are immobilized to each other in the axial direction as well as in the rotational direction.

The slitted shaft 111, which has a cylindrical form, is made of an elastic material such as plastic and has a couple of slits 115 defined on the circumference to extend in the longitudinal direction. A chuck 121 having a cylindrical form is housed in the slitted shaft 111, and the front end portion of the chuck 121 is designed to have a shape (e.g. a cavity) such that it can hold a cosmetic material therein, while the rear end portion thereof has a couple of ridges 123 formed on the circumference. The ridges 123 protrude out of the slits 115 of the slitted shaft 111 and are abutted against the lower end of a spring 129. The spring 129 is wound around the circumference of the slitted shaft 111, with the upper end thereof being retained on the step formed in the cartridge cylinder 103 and the lower end thereof being retained on the ridges 123 of the chuck 121, so that the chuck 121 is normally urged downward. When the chuck 121 is to be fitted in the slitted shaft 111, the slits 115 may easily be opened wide to allow insertion of the chuck 121 therethrough, because the slitted shaft 111 is made of an elastic material.

Engagement grooves 119 are defined on the inner surface of the slitted shaft 111 at the rear opening 117, in which the protrusions 93 arranged in rows on the push rod 91, shown in FIG. 7, intrude and are engaged. Accordingly, after insertion of the cartridge 101 to the main body 70, the push rod 91, the slitted shaft 111 and the cartridge cylinder 103 can be turned synchronously. Meanwhile, the tip of the push rod 91 is abutted against the rear end of the chuck 121. When the outer barrel 71 (together with the inner barrel 81 including the internal thread section 83) and the cartridge cylinder 103 are turned relative to each other in this state, the protrusions 93 of the push rod 91 move vertically along the spiral groove 85, whereby to advance or retract the push rod 91, in turn, the chuck 121 and the stick type cosmetic material held thereon interlocking with the push rod 91.

Figure 9:
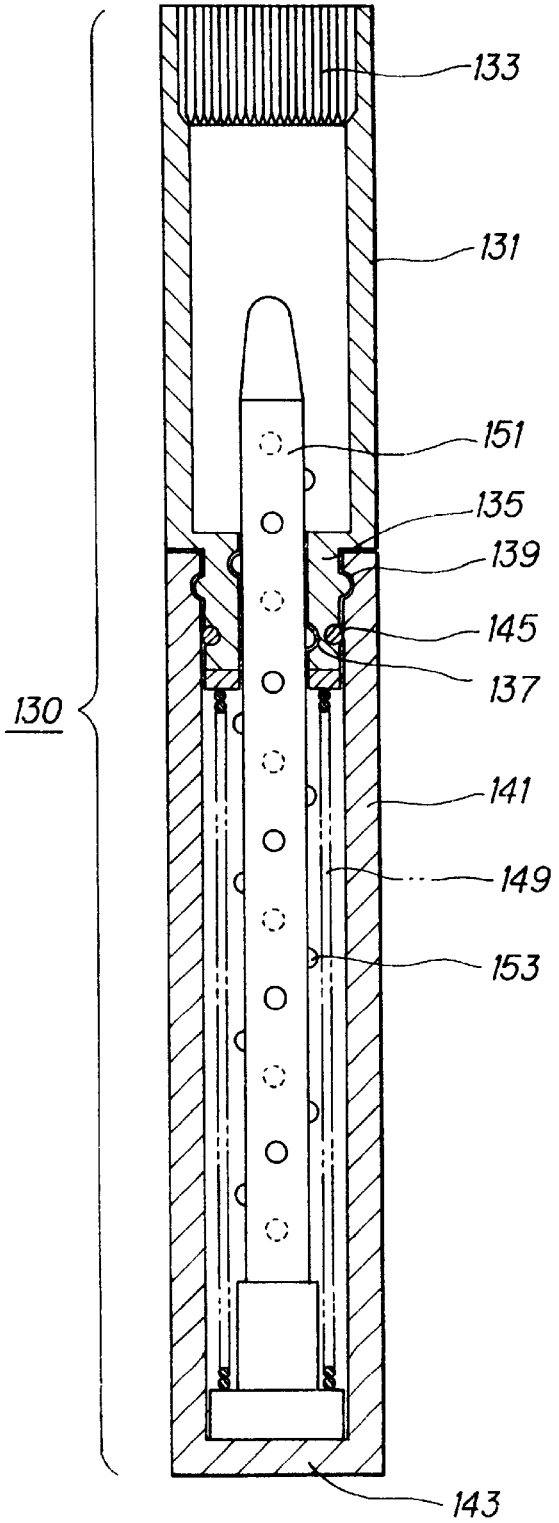
FIG. 9 shows a cross-sectional view of the main body of the cartridge type container having a holder according to one embodiment of the invention.

FIG. 9 shows a cross-sectional view of the main body of the cartridge type container having a holder according to one embodiment of the invention. A main body 130 consists of a holder 131, a barrel 141 and a push rod 151. The holder 131 has a cylindrical form and also has an opening to allow insertion of a cartridge (not shown) therethrough is defined at the front end. The opening is provided with a rotation-stop (e.g. ridge and recess engagement) 133. An internal thread section 135 is formed at the rear end portion of the holder 131 in which a spiral groove 137 is formed.

The barrel 141 has, for example, a cylindrical form with a closed bottom 143 and is rotatably engaged at the rotary fitting section 139 thereof with the rear end portion of the holder 131. An O-ring 145 is fitted between the inner surface of the barrel 141 and the outer surface at the rear end portion of the holder 131. The O-ring 145 is directed to provide an appropriate frictional resistance between the barrel 141 and the holder 131 during relative rotation thereof, whereby an accident such that the user turns them relative to each other over an intended level can be prevented. Further, when the push rod 151 is urged backward by a spring 149 and the like, a rotational force is applied to the holder 131 (the holder rotates idling to allow the push rod to retract), but the O-ring provides a resistance and prevents idling rotation of the holder 131.

When a cartridge is inserted to the holder 131, the engagement grooves of the grooved member in the cartridge and the protrusions 153 of the push rod 151 are engaged, like in the embodiment as shown in FIGS. 7 and 8, and thus the push rod 151 can be fed by turning the holder 131 with the cartridge being held between the fingers. When the cartridge is removed to allow free rotation of the push rod 151, the push rod 151 resets spontaneously to the original position (retracted extremity) due to the resilience of the spring 149. In spite of the holder 131 being provided on the barrel 141 of the container in this embodiment, the push rod 151 is not adapted to be advanced or retracted by turning the holder 131 only. It is not until a cartridge is inserted to achieve engagement between the engagement grooves of the cartridge and the protrusions 153 of the push rod 151 that the push rod 151 can be advanced or retracted. When the cartridge is removed, the push rod 151 is allowed to turn freely and resets to the original position without turning the holder. Accordingly, inadvertent damage of the push rod or the cosmetic material can be prevented.

Figure 10:
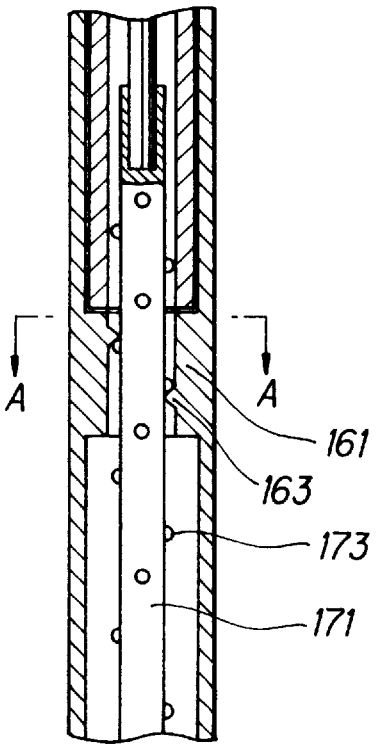
FIG. 10 shows a cross-sectional view of the feeding mechanism according to another embodiment of the invention.
Figure 11A:
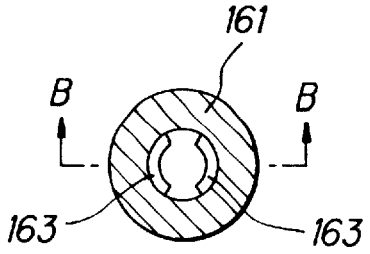
FIG. 11 shows the spiral engagement ridges of the mechanism shown in FIG. 10, in which (A) is the cross section taken along the line A—A of FIG. 10, and (B) the cross section taken along the line B—B of (A).
Figure 11B:
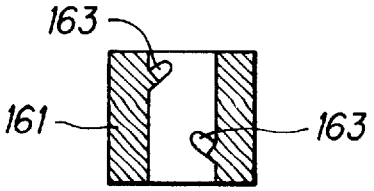

FIG. 10 shows a cross-sectional view of the feeding mechanism according to another embodiment of the invention. FIG. 11 shows the spiral engagement ridges of the mechanism shown in FIG. 10, in which (A) is the cross section taken along the line A—A of FIG. 10, and (B) the cross section taken along the line B—B of (A). In this embodiment, a group of protrusions 173 provided on the outer surface of a push rod 171 are engaged with the spiral ridges 163 formed on the inner surface of a barrel 161. The spiral ridges 163 are provided on the inner surface of the barrel 161, and at least one of the group of protrusions 173 on the outer surface of the push rod 171 is engaged at the lower portion thereof with one spiral ridge 163 and at least one other protrusion 173 is engaged at the upper portion thereof with another spiral ridge 163. Accordingly, the push rod 171 can be retained at a predetermined position in the axial direction. When the push rod 171 and the barrel 161 are turned relative to each other, the protrusions 173 slide along the spiral ridges 163 to advance or retract the push rod 171. As shown in FIG. 11 (A),(B), the spiral ridges 163 need not be formed one round along the inner surface of the barrel 161. Thus, when the barrel 161 is formed by injection molding using a plastic material, it can be formed without using a core pin of rotation releasing type.

Figure 14:
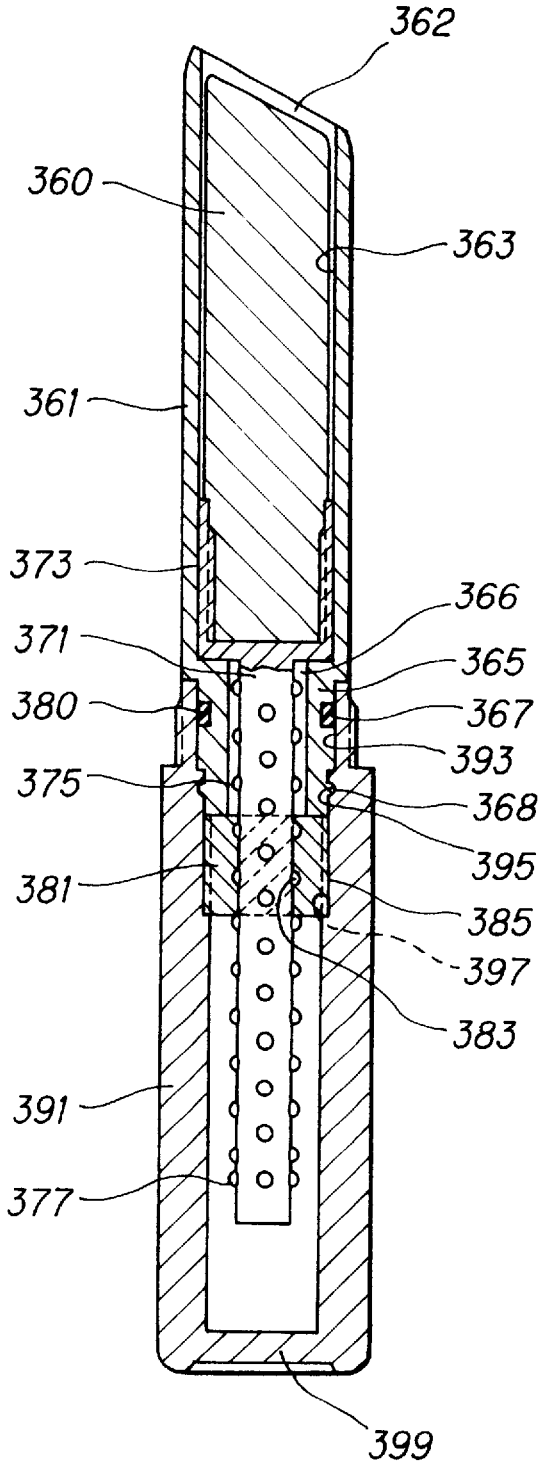
FIG. 14 shows a cross-sectional view of a lipstick container according to one embodiment of the invention.

FIG. 14 shows a cross-sectional view of a lipstick container according to one embodiment of the invention. The basic constitution of the lipstick container is substantially the same as the container for feeding a stick type cosmetic material shown in FIG. 5. A lipstick 360 is inserted at the rear end portion (lower end portion in FIG. 14) to a chuck 373 and supported therein. The chuck 373 is formed integrally with a push rod 371. The chuck 373 and the lipstick 360 can slide in the bore 363 of a front barrel 361 as the push rod 371 is advanced or retracted. The end face (upper end) of the tip opening 362 of the front barrel 361 is truncated diagonally. Likewise, the tip of the lipstick 360 is truncated diagonally.

The rear end portion of the front barrel 361 constitutes a rotation-stop section 365. The rotation-stop grooves 366 formed on the inner surface of the rotation-stop section 365 and the protrusions 375 provided on the outer surface of the push rod 371 are engaged unrotatably but slidably in the axial direction. Accordingly, the push rod 371 and the front barrel 361 can be turned synchronously. The outer circumference of the rotation-stop section 365 is rotatably fitted in the bore 393 of a main barrel 391. An O-ring groove 367 is defined along the outer circumference of the rotation-stop section 365, in which an O-ring 380 is fitted. The O-ring 380 provides an appropriate sliding resistance when the front barrel 361 and the main barrel 391 are turned relative to each other. Engagement ridges 368 formed on the outer circumference of the rotation-stop section 365 and the engagement recess 395 formed in the front end bore 393 of the main barrel 391 are engaged with each other to prevent slipping off of these barrels (they can be rotated relative to each other).

The push rod 371 has a group of protrusions 375 formed on the outer surface thereof at a predetermined pitch. The protrusions 375 are engaged with the spiral grooves 383 formed on the inner surface of an internal thread member 381. The internal thread member 381 is unrotatably locked by the knurls 385 provided on the outer surface thereof and the knurls 397 formed on the inner surface of the main barrel 391. Incidentally, the main barrel 391 of the lipstick container shown in FIG. 14 has a cylindrical form with a bottom 399. When the front barrel 361 and the main barrel 391 of the lipstick container shown in FIG. 14 are turned relative to each other, the push rod 371 and the internal thread member 381 are turned relative to each other to allow the push rod 371, the chuck 373, in turn, the lipstick 360 to be fed out or retracted.

In the lipstick container shown in FIG. 14, a stopper (protrusions) 377 for defining the advanced extremity of the push rod 371 is provided at the lower end portion on the outer surface of the push rod 371. The stopper 377 is not engaged with the spiral groove 383 of the internal thread member 381 (the spiral groove is absent at the corresponding portion) but abutted against the lower end face thereof. Thus, the push rod 371 is prevented from ascending (advancing) any further. The presence of such stopper 377 prevents the internal thread member 381 from being assembled upward onto the push rod 371 from the bottom thereof. Accordingly, the internal thread member 381 is severed and allowed to have a form of C ring, so that it can be fitted from the lateral side of the push rod 371.

Figure 15A:
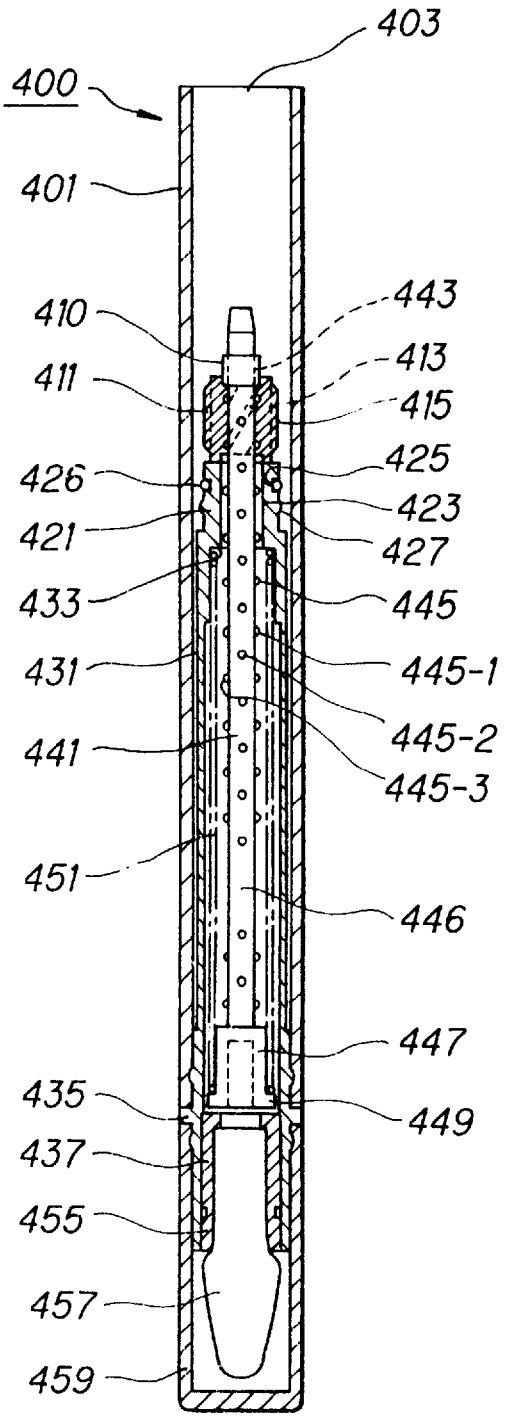
FIG. 15 shows in cross-sectional view the main body of the container for feeding a stick type cosmetic material according to one embodiment of the invention; in which (A) is the state where the push rod is at the retracted extremity; and (B) is the state where the push rod is at the advanced extremity.

FIG. 15 shows in cross-sectional view the main body of the container for feeding a stick type cosmetic material according to one embodiment of the invention; in which (A) is the state where the push rod is at the retracted extremity; and (B) where the push rod is at the advanced extremity. The main body 400 in this embodiment consists of an outer barrel 401, an inner barrel 431, an internal thread member 411, a push rod 441, a sponge chip 457 and a cap 459. The outer barrel 401 has a cylindrical shape and covers the circumference at the middle and upper portions of the main body 400. The inner barrel 431 has a hollow cylindrical shape, and the front (upper) end portion thereof is constricted to constitute a rotation-stop section 421. The outer surface of the rotation-stop section 421 serves as the connecting section for connecting the inner barrel 431 with a cartridge, and an annular ridge 427 is formed thereon, with which the annular recess 529 formed at the rear end portion of the cartridge (to be described later referring to FIG. 16) is engaged to achieve connection between the cartridge 471 and the outer barrel 401.

Four rotation-stop grooves 423 are formed on the inner surface of the rotation-stop section 421 to extend in the axial direction. The rotation-stop grooves 423 are engaged with the group of protrusions 445 arranged linearly on the outer surface of the push rod 441 in the axial direction and allows the inner barrel 431 and the push rod 441 to synchronously turn slidably in the axial direction. Incidentally, since the outer barrel 401 and the inner barrel 431 are immobilized to each other (by means of press fitting, an adhesive, etc.), the outer barrel 401 and the push rod 441 can eventually be turned synchronously.

The internal thread member 411 has a cylindrical form, and two spiral grooves 413 are formed on the inner surface thereof. The number of groove may be single or plural. The spiral grooves 413 are engaged with the group of protrusions 445 provided on the outer surface of the push rod 441, and they constitute the same mechanism as that of the combination of an internal thread and an external thread. The internal thread member 411 has on the outer surface thereof eight synchronously engageable ribs 415 to extend axially. When a cartridge is inserted to the main body 400 of the container, the ribs 415 intrude into the synchronously engageable grooves 527 (FIG. 16) formed on the inner surface at the lower portion of a cartridge cylinder 481 and engaged therewith to allow the cartridge cylinder to turn synchronously with the internal thread member 411.

A group of protrusions 445 are provided on the outer surface of the push rod 441 in this embodiment. The protrusions 445 are arranged in four rows with an angle of 90° between the rows in the circumferential direction and at a predetermined pitch. The protrusions 445 in two rows opposing to each other at an angle of 180° are arranged in the same manner (at the heights) in the axial direction. These protrusions 445 are arranged spirally, for example, in the order of 445-1, 445-2, 445-3 . . . on the outer circumference of the push rod 441, and the lead of the spiral is twice as large as the pitch between the horizontal rows of protrusions 445. The protrusions arranged spirally serve as a thread. The respective parts in the container for feeding a stick type cosmetic material in this embodiment are of plastic injection moldings. The material can be exemplified by ABS (acrylonitrile-butadiene-styrene) and POM (polyoxymethylene), etc.

The main body 400 of the embodiment shown in FIG. 15 is incorporated with a push spring 451. The push spring 451 is interposed between the upper end face of the rear end flange 449 of the push rod 441 and the end face at the inner step 433 of the bore in the inner barrel 431 to surround the push rod 441, and this push spring 451 urges to push the push rod 441 backward. Due to the presence of the push spring 451, the push rod 441 is forced to return spontaneously to the retracted extremity from the feeding position linearly (not turning), whenever the cartridge is removed to allow free rotation of the internal thread member 411. Thus the push rod 441 is always returned to the retracted extremity whenever the cartridge is detached for replacement, so that the stick type cosmetic material is prevented from being fed out inadvertently when a new cartridge is inserted. Thus, damage of the stick type cosmetic material can be prevented. Further, since the push rod and the inner barrel are prevented to turn relative to each other in such spontaneous resetting process, no distortional force is applied to the push spring 451 to provide smooth movement of the mechanism.

Figure 15B:
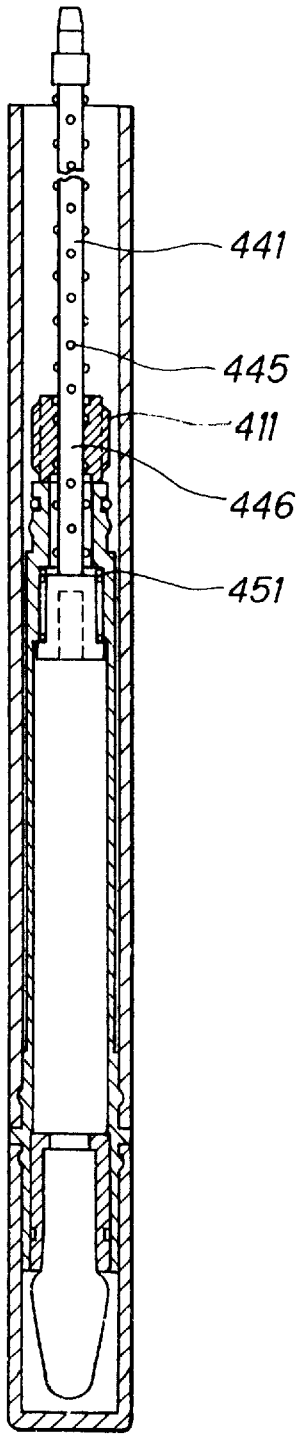

In this embodiment, the retracted extremity of the push rod 441 is defined by the lower end face of a slip stopper ring 410 fitted to the tip of the push rod 441, which is abutted against the upper end face of the internal thread member 411. The slip stopper ring 410 has a C-shaped horizontal cross section and can be formed by severing a cylindrical ring. The slip stopper ring 410 can be fitted in the annular groove 443 formed on the circumference of the push rod 441 by opening the ring. As shown in FIG. 15(B), the slip stopper ring 410 fitted on the front end portion of the push rod 441 is fed into the 481 cylinder as being attached to the front end portion of the push rod 441. When the push rod 441 is retracted to allow the lower end face of the slip stopper ring 410 to abut against the upper end face of the internal thread member 411, the push rod 441 is prevented from retracting any further. Because of the structure, there is no need of providing a plug to the rear end (bottom) opening of the inner barrel 431. Incidentally, a brush and the like may be attached to the rear end opening, and thus various types of container for feeding a stick type cosmetic material can be provided. In the embodiment shown in FIG. 15, a sponge chip 457 retained in a chip holder 455 is attached to the rear end opening. The chip 457 is covered with a cap 459.

An O-ring 426 is fitted in the annular O-ring groove 425 formed on the outer surface of the rotation-stop section 421 of the inner barrel 431. The role of the O-ring 426 is to provide a predetermined rotational resistance between the cartridge cylinder 481 (shown in FIG. 16) and the inner barrel 431. If no such resistance is provided, the push rod 441, the internal thread member 411 and the cartridge cylinder 481 are integrally rotated idling due to the resilience of a pull spring 501 and the push spring 451 of the cartridge to allow the push rod 441 to retract spontaneously to the retracted extremity. Incidentally, the cartridge cylinder 481 and the inner barrel 431 are engaged by the annular recess formed on the cartridge cylinder and the annular ridge 427 formed on the inner barrel 431 so that they may not be deviated in the axial direction.

The lower portion of the push rod 441 of the main body 400 shown in FIG. 15 has a cylindrical flat portion 446 having no protrusions 445 thereon. The diameter of the flat portion 446 of the push rod 441 is the same as that of the cylindrical shaft on which a group of protrusions 445 are provided. The flat portion 446 is brought to a position where it can be fitted in the internal thread member 411, when the push rod 441 is at the advanced (uppermost) extremity, as shown in FIG. 15(B). Accordingly, if the cartridge and the main body are turned relative to each other in this state, the internal thread member 411 and the push rod 441 make an idling rotation. The user can thus definitely know that the stick type cosmetic material has reached the advanced extremity by such idling rotation.

Incidentally, the length of the flat portion 446 is designed to be shorter than the length of the rotation-stop section 421. Thus, when the flat portion 446 passes the rotation-stop section 421, the protrusions 445 locating above or below the flat portion 446 engage with the rotation-stop groove 423, so that the push rod 441 and the rotation-stop section 421 are prevented from making an idling rotating. Since the push rod 441 is urged backward by the push spring 451 and the pull spring 501 (FIG. 16) of the cartridge, the protrusions 445 of the push rod 441 slip in and out of the spiral grooves 413, whenever such idling rotation occurs to give clicks. There may be formed vertical grooves on the inner surface of the inner barrel 431, and protrusions on the outer surface of the rear end flange 449 of the push rod, which are engaged with each other to allow the push rod 441 and the main body 400 to turn synchronously.

FIG. 16 shows a cross-sectional view of the cartridge to be inserted to the container for feeding a stick type cosmetic material shown in FIG. 15; in which (A) is a cross-sectional view, and (B) is a side view. The cartridge 471 consists of three parts: a cylinder 481, a core chuck 491 and a pull spring 501. The characteristics of the cartridge shown in FIG. 16 are that the pull spring 501 for urging the core chuck 491 backward is provided and that chuck stoppers 486 are of a resilient structure having an inward projection 487.

Figure 16A:
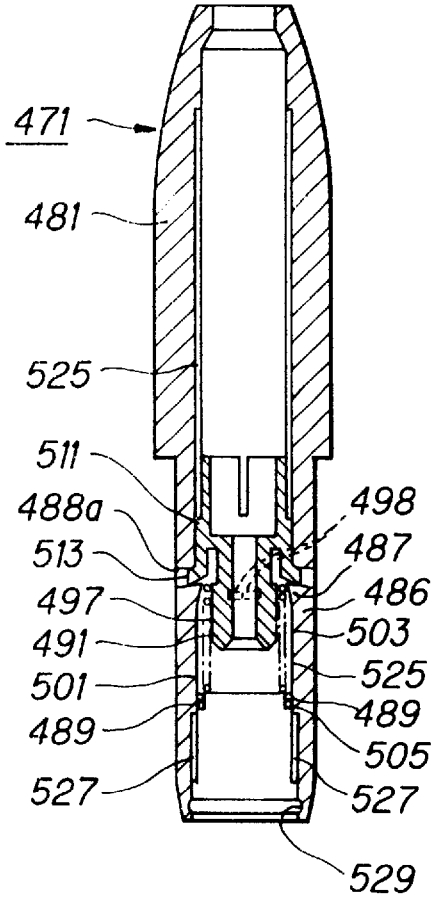
FIGS. 16A and 16B show a cross-sectional view and a side view, respectively, of the cartridge to be inserted to the container for feeding a stick type cosmetic material shown in FIG. 15.
Figure 16B:
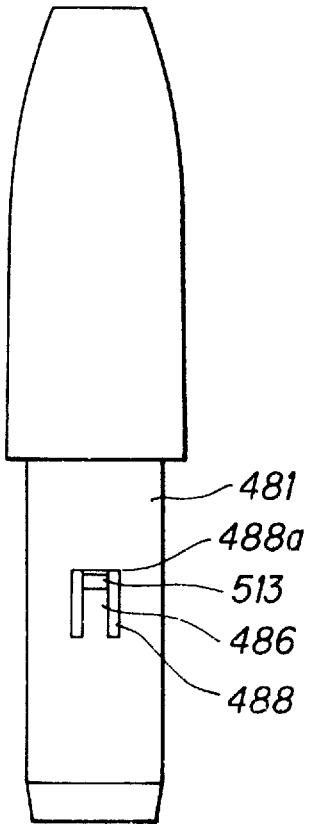

The chuck stopper 486 of the cartridge 471 shown in FIG. 16 has a tongue-like shape and is formed by defining a U-shaped slit 488 on the lateral side of the cylinder 481, as shown in FIG. 16(B). The upper portion of the chuck stopper 486 is slightly protruded inward to constitute the inward projection 487, as shown in FIG. 16(A). Each abutting portion 513 of the resilient piece 511 of the core chuck 491 is fitted in the upper space 488*a* of the slit 488 due to its resilience. Accordingly, the level of interference between the abutting portion 513 and the inward projection 487 of the chuck 486 stopper amounts to the sum of the protrusion of the abutting section 513 and the internally projection of the inward projection 487 of the chuck stopper 486, so that a greater level of interference can be secured compared with the case where the resilient pieces 511 of the core chuck 491 are singly employed. Thus, slipping off of the core chuck 491 can more securely be prevented.

The pull spring 501 of the cartridge 471 of the embodiment shown in FIG. 16 is a coil spring. The diameter of the pull spring 501 is increased at the rear end portion 505 which is abutted against the spring tail retaining surface 489 at the lower portion on the inner surface of the cartridge cylinder 481, whereby the rear end portion 505 of the spring is fixed so as not to be moved toward the front end of the cylinder 481. The front end portion 503 at the upper end of the pull spring 501 is caught by the bosses 498 of the spring head retaining section 497 at the lower portion of the core chuck 491 and thus connected therewith.

Figure 17:
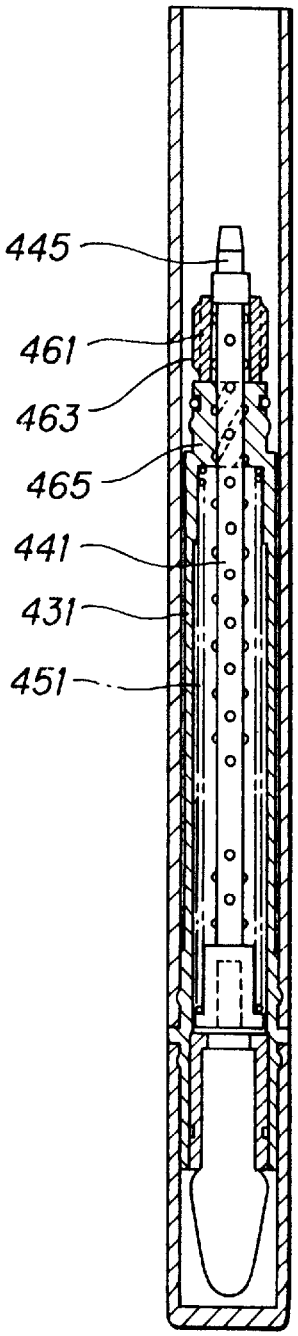
FIG. 17 shows a cross-sectional view of the main body of the container for feeding a stick type cosmetic material according to another embodiment of the invention.

FIG. 17 shows a cross-sectional view of the main body of the container for feeding a stick type cosmetic material according to another embodiment of the invention. The main body in this embodiment is quite similar to that of FIG. 15, but the positional relationship between the internal thread and the rotation-stop is reversed. More specifically, an internal thread section 465 having spiral grooves engaging with the protrusions of a push rod 441 is formed integrally at the front end of an inner barrel 431. Further, a rotation-stop member 461, having grooves which are engaged with the group of protrusions provided on the push rod 441 slidably in the axial direction but unrotatably, is fitted on the push rod 441 on the front end side of the internal thread section 465 near the front end of the outer barrel to be rotatable together with the main body of the container.

When the cartridge shown in FIG. 16 is inserted to the stick type cosmetic material feeding container shown in FIG. 17, the synchronously engageable ribs 463 formed on the outer surface of the rotation-stop member 461 engage with the synchronously engageable grooves 527 of the cartridge cylinder 481, whereby the rotation-stop member 461 and the cartridge cylinder 481 can be turned synchronously to advance or retract the push rod 441. In this state, the push rod 445 does not make any relative rotation in the cartridge but moves straight in the axial direction. Meanwhile, the push rod 441 advances or retracts rotating in the inner barrel 431. Accordingly, when the cartridge is removed from the main body of the container to allow free rotation of the rotation-stop member 461, the push rod 441 is urged by a push spring 451 to return spontaneously to the retracted extremity while it rotates in the main body of the container.

One of the great characteristics of the stick type cosmetic material feeding containers shown in FIGS. 15, 16 and 17 is that the number of parts in the cartridge is minimized by incorporating the rotation-stop member and internal thread member into the main body of the container. Thus, the cost of the cartridge can be held minimum. In this type of stick type cosmetic material feeding containers, since users generally purchase several cartridges and use them for one container, it is of great significance to reduce the cost of the cartridge.

A second great characteristic of these containers is that the cartridge shown in FIG. 16 can be used in the main body of FIG. 15 or that of FIG. 17 (interchangeable). Accordingly, the combination between the cartridges and the main bodies is diversified. Incidentally, if such interchangeability works rather disadvantageously (e.g. retail stores provide interchangeable cartridges and containers manufactured by different makers), it can be eliminated by appropriately changing the shape of the engaging sections of the cartridge cylinder and of the rotation-stop member or the internal thread member. Further, such interchangeability can also be eliminated by changing the manner of engagement between the rear end of the chuck and the front end of the push rod.

A third great characteristic of these containers is that the manner of engagement between the cartridge and the main body of the container is all achieved between the inner surface at the rear end portion of the cartridge cylinder and the front end outer surface of the inner barrel of the container. More specifically, the engagement ridges and recesses or the frictional members (O-ring), etc. which are the mechanisms for connecting rotatably the cartridge and the main body of the container under appropriate frictional resistance therebetween concentrate at such portions. Accordingly, in the applied embodiments employing the outer barrel or holder, design changes which must be made in the outer barrel, holder or cartridge may be minimum. For example, the outer barrel can be a simple pipe. Namely, such containers with ornamental quality, the designs of which are particularly important, can easily be provided over a wide variety based on the stick type cosmetic material feeding container according to these embodiments of the invention.

Figure 18:
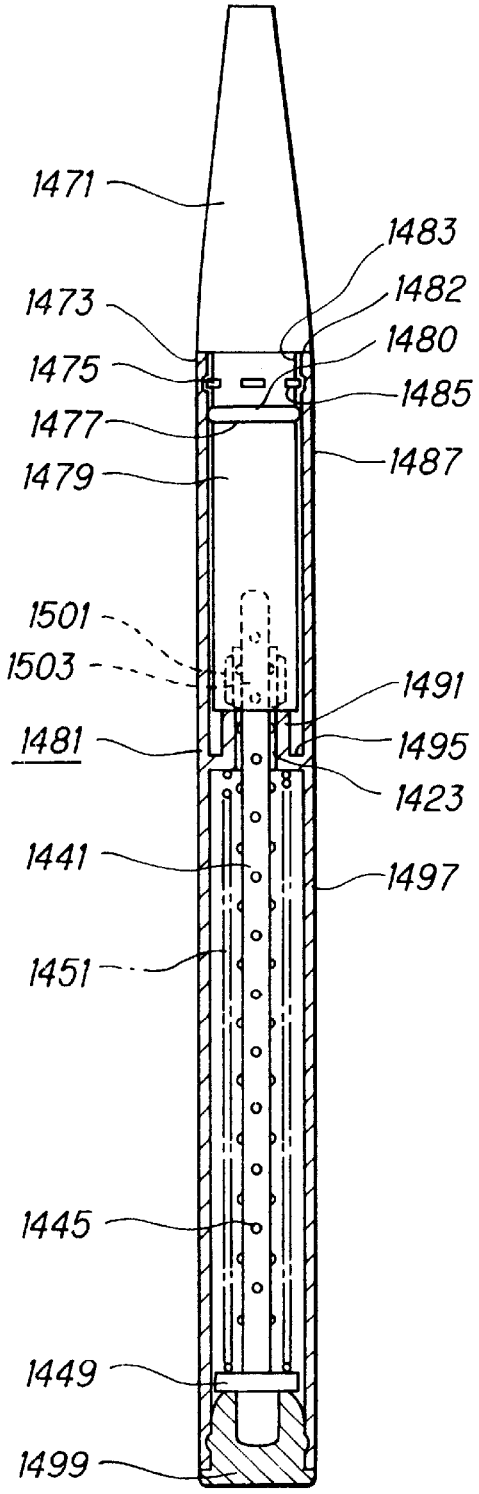
FIG. 18 shows partly in cross-sectional view the container for feeding a stick type cosmetic material according to another embodiment of the invention.

FIG. 18 shows partly in cross-sectional view the container for feeding a stick type cosmetic material according to another embodiment of the invention. A first aspect of this feeding container which is different from that of the container of FIG. 15, etc. resides in the structure of the engagement between the cartridge and the main body of the container. More specifically, in the stick type cosmetic material feeding container shown in FIG. 18, the axial engagement of the cartridge with the main body of the container and rotational frictional resistance are both achieved or provided at the tip opening 1483 of the socket 1487 at the upper portion of the barrel 1481 of the main body of the container and the outer surface of the insertion section 1479 of the cartridge 1471.

In FIG. 18, the insertion section 1479 corresponding to the lower half of the cartridge 1471 is inserted to the socket 1487 defined at the upper part of the main body 1481 of the container. Engagement ridges 1475 are provided on the insertion section 1479 of the cartridge 1471, which engage rotatably with the annular groove 1485 formed on the inner surface of the socket 1487. An O-ring groove 1477 is defined on the insertion section 1479 of the cartridge 1471 below the engagement ridges 1475, in which an O-ring 1480 is fitted. The O-ring 1480 provides an appropriate rotational resistance between the main body of the container and the cartridge.

Preferably, the upper end face 1482 of the main body 1481 of the container is abutted against the step 1473 of the cartridge 1471 intimately against each other, or a very small clearance may be secured therebetween, under engagement of the engagement ridges 1475 with the annular groove 1485, so as to ensure good appearance of the container. In the stick type cosmetic material feeding container of the type shown in FIG. 18, the engagement recess and ridges 1485, 1475 are formed close to the upper end 1482 of the main body of the container, so that the dimensional errors in producing them depend only on the dimensional errors in molding the main body of the container and the cartridge cylinder. Accordingly, these contact sections can be formed with good accuracy.

A second characteristic of the stick type cosmetic material feeding container of FIG. 18 is that the main body 1481 is an integral body. More specifically, the socket section 1487, the rotation-stop section 1491 and the lower barrel 1497 are formed integrally by injection molding using a plastic material. Accordingly, the number of parts can be reduced compared with the feeding containers of FIGS. 15 and 17, and thus the production cost can be reduced. Incidentally, a plug 1499 is fitted in the lower end portion of the main body 1481 of the container to define the retracted extremity of the push rod 1441. Meanwhile, a push spring 1451 urges the push rod 1441 to be pushed backward is disposed between the partition 1495 provided at the middle of the main body 1481 and the rear end flange 1449 of the push rod 1441.

As apparent from the above description, the mechanism and the container according to this invention exhibit the following effects:

(1) Since there are less limitations in production of the push rod according to this invention than the one having a continuous thread, elongated thin push rods having desired pitches can be obtained, and thus the feeding mechanism and container of the invention can be made compact and allowed to have higher facility;

(2) Depending on the grouping (selection) of the protrusions provided on the outer surface of the push rod so as to occupy partially at strategic positions an imaginary continuous spiral space, the pitch, lead and direction of torsion of the resulting "screw" can arbitrarily be selected within a certain range;

(3) Since the group of protrusions can be arranged strictly or substantially in alignment on the outer surface of the push rod, the protrusions provided on the same push rod can partly be utilized spirally as an external thread structure and also partly be utilized in axial rows as a rotation-stop section for stopping turning of the push rod, and thus the basic structures of the feeding mechanisms or containers having various functions can be realized economically;

(4) Since the protrusions on the surface of the push rod can be of a simple shape, the push rod can be produced easily, and this effect manifests particularly in a comparison with the case where a thread must be formed on the push rod over the entire length thereof, requiring laborious thread machining or die making;

(5) Since the length of the internal thread section (or spiral engagement ridges) to be engaged with the protrusions of the push rod can be short, the internal thread section can be produced easily, and particularly when such spiral engagement ridges are allowed to function as the internal thread, it can be formed by injection molding without using a core pin of rotation releasing type;

(6) Since the push rod itself has a spiral function, the diameter of the push rod and that of the main body of the container can be reduced, compared with the case where engagement protrusions (or external thread) are provided at the rear end portion of the push rod and an internal thread is provided to the main body of the container (Japanese Utility Model Publication No. 50814/1991 etc.); and (7) In the cartridge type container of the embodiment shown in FIG. 9, in spite of the holder provided on the main body of the container, the push rod cannot be advanced or retracted by turning the holder only, and it is not until a cartridge is inserted that the push rod can be advanced or retracted, so that it never happens that the core material is broken during cartridge replacement.

Figure 19:
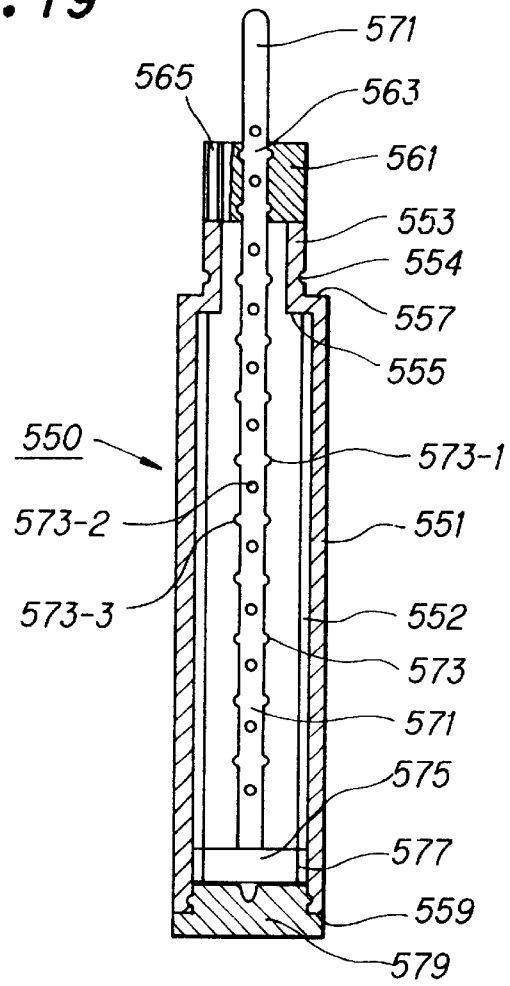
FIG. 19 shows in cross-sectional view the internal structure of the container for feeding a stick type cosmetic material according to still another embodiment of the invention.
Figure 20A:
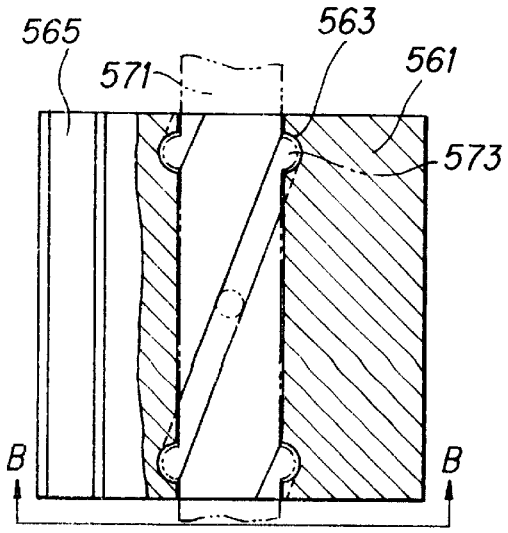
FIG. 20 shows an enlarged view of the internal thread member in the body of the container shown in FIG. 19, in which (A) is a cross-sectional view, and (B) is a view taken along the line B—B of (A)
Figure 20B:
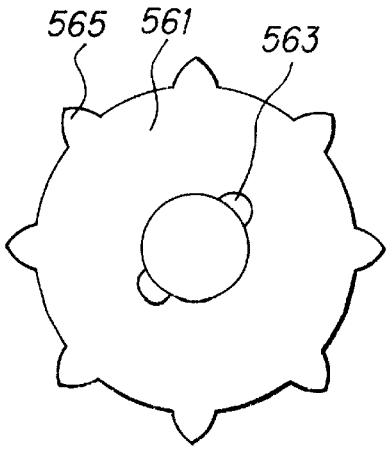

FIG. 19 shows in cross-sectional view the internal structure of the main body of the container of a type where the rear end portion of the push rod and the main body of the container are engaged in such a way that they can be turned synchronously. FIG. 20 shows an enlarged view of the internal thread member in the main body of the container shown in FIG. 19, in which (A) is a cross-sectional view and (B) is a view taken along the line B—B of (A).

The main body 550 of the container in this embodiment consists of a barrel 551, an internal thread member 561, a push rod 571 and a plug 579. The barrel 551 has a hollow cylindrical form and also has a constricted connecting section 553 at the front end (upper) portion. An annular groove 554 is defined on the outer surface of the connecting section 553, with which protrusions formed at the rear end portion of the cartridge cylinder (not shown in FIG. 19) are engaged to achieve connection between the cartridge and the main body of the container.

The portion other than the connecting section 553 of the barrel 551 generally has a simple cylindrical form. Two vertical grooves 552 extending in the axial direction are defined on the inner surface of the barrel 551 to oppose to each other with an angle of 180° therebetween. The butts 577 provided on the circumference of the rear end flange 575 engage with the vertical grooves 552 slidably in the axial direction, so that the push rod 571 and the barrel 551 can be turned synchronously. A plug 579 is fitted to the rear end portion of the barrel 551 to define the retracted extremity of the push rod 571. Incidentally, the synchronous turning of the push rod 571 and the barrel 551 may be achieved by linear grooves extended in the axial direction on the inner surface at the front end portion of the barrel (connecting section 553) and are engaged with the vertical (axial) rows of protrusions 573 arranged on the outer surface of the push rod 571.

The internal thread member 561 has a cylindrical form. Two spiral grooves 563 are formed on the inner surface of the internal thread member 561. The number of the spiral groove 563 may be one or more. The group of protrusions 573 provided on the outer surface of the push rod 571 engage with the spiral grooves 563, and they together constitute the same mechanism as the combination of internal thread and external thread. Eight synchronously engageable ribs 565 are formed on the outer surface of the internal thread member 561 to extend in the axial direction. These ribs 565 intrude into the synchronously engageable grooves formed on the inner surface at the lower portion of the cartridge cylinder, when the cartridge is inserted to the main body, so that the cartridge cylinder and the barrel may be turned synchronously.

The group of protrusions, provided on the outer surface of the push rod 571 in this embodiment, are arranged in four rows in the axial direction at a predetermined pitch with an angle of 90° between the rows in the circumferential direction, in which those protrusions 445 in two rows opposing to each other with an angle of 180° therebetween are arranged in the same manner (at the same heights) in the axial direction. Since no costly elongated screw member is necessary in the container of the embodiment shown in FIG. 19, production cost can be reduced.

Figure 21:
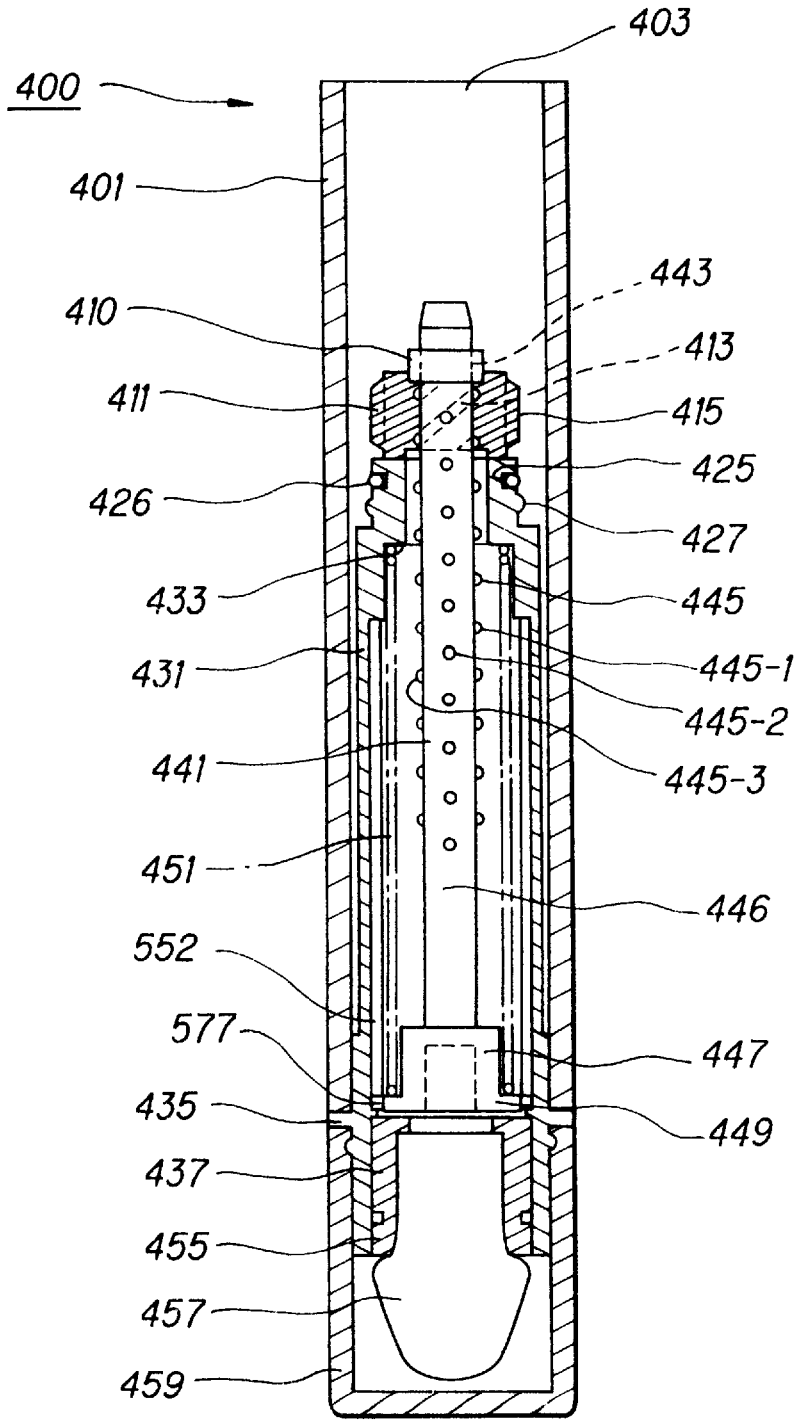
FIG. 21 shows a cross-sectional view of the body of the feeding container according to one embodiment of the invention, which is a combination of the main body of the container shown in FIG. 15 and that of FIG. 19.

FIG. 21 shows a cross-sectional view of the feeding container according to one embodiment of the invention, which is a combination of the main body of the container of FIG. 15 and that of FIG. 19. In this type of container, butts 577 are formed on the circumference of the rear end flange 449 of a push rod 441, while vertical grooves 552 are defined on the inner surface of the inner barrel 431 to extend in the axial direction. The butts 577 and the vertical grooves 552 are engaged slidably in the axial direction but unrotatably. Thus, the push rod 441 and the main body of the container can be turned synchronously.

Accordingly, the rotation-stop groove (423 in FIG. 15) to be engaged with the group of protrusions 445 provided on the outer surface of the push rod becomes unnecessary in the container of FIG. 21.

The push rod of the container shown in FIG. 21 has a flat portion 446 like in the case of the push rod of the container shown in FIG. 15. The action of the flat portion is the same as in the case of the container of FIG. 15. However, the group of protrusions 445 provided on the outer surface of the push rod do not engage with the rotation-stop grooves in the container of FIG. 21 but engage only with the spiral grooves 413 of the internal thread member 411, so that no consideration is necessary on the relationship between the flat portion 446 and the rotation-stop grooves in designing the mechanism, and thus the degree of freeness in design can be improved. For example, total length of the container can be short since rotation-stop grooves should not be so long as those of the container in FIG. 15.

Figure 22:
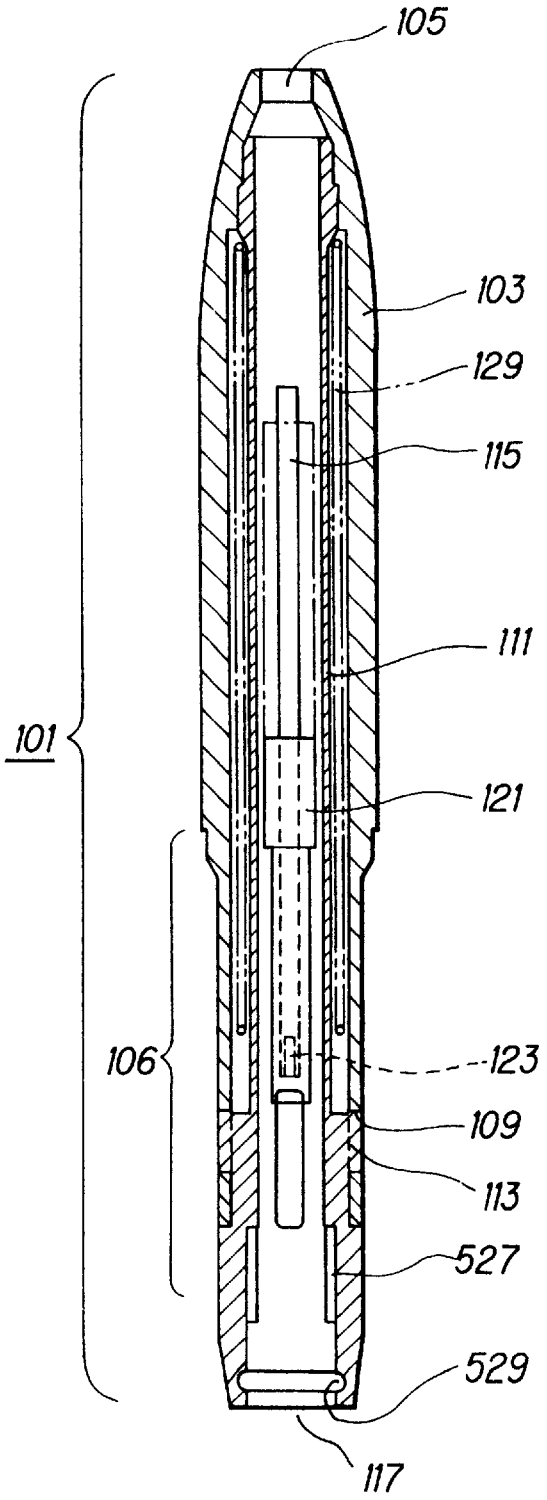
FIG. 22 shows in cross section a cartridge according to one embodiment of the invention, which can be used in combination with the main body of the container shown in FIGS. 15, 17 or 21.

FIG. 22 shows in cross section a cartridge according to one embodiment of the invention, which can be used in combination with the main body of the container shown in FIGS. 15, 17 or 21. The structure of the cartridge is basically the same as that of FIG. 8. However the engaging section at the lower end portion of the cartridge to be engaged with the main body of the container is the same as that of the cartridge shown in FIG. 16.

Next, the cartridge for the stick type cosmetic material feeding container will be described more specifically. The cartridge according to this invention employs effectively a pull spring and a chuck stopper so as to reduce the diameter of the cartridge or the number of parts as well as to prevent damage of the stick type cosmetic material in the cartridge.

Figure 28:
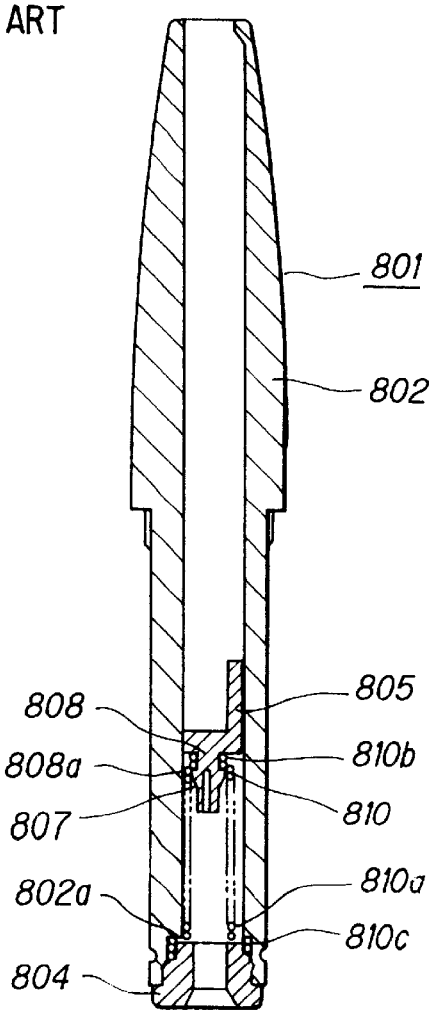
FIG. 28 PRIOR ART
FIG. 28 shows in cross-sectional view the structure of the cartridge for the cosmetic material container, having a pull spring for spontaneous resetting of the core chuck, disclosed in Japanese Utility Model Publication No. 31232/1991.

FIG. 28 shows in cross-sectional view the structure of the cartridge for the cosmetic material container, having a pull spring for spontaneous resetting of the core chuck, disclosed in Japanese Utility Model Publication No. 31232/1991. The cartridge 801 has a core chuck 805 disposed slidably in the vertical (axial) direction in the cartridge cylinder 802. The core chuck 805 is provided with a projection 807 on the lower surface thereof. The projection 807 has a constriction 808 and a spring retaining step 808*a*. A pull spring 810 consisting of three portions, i.e. a reduced diameter portion 810*b*, a main portion 810*a* and an enlarged diameter portion 810*c* downward in this order is disposed in the cartridge cylinder 801. The top reduced diameter portion 810*b* of the pull spring 810 is fitted on the circumference of the ridge 807 of the core chuck 805. Meanwhile, the bottom enlarged diameter portion 810*c* is abutted against the step 802*a* formed at the lower end portion of the cartridge cylinder 802 and also regulated at the bottom by a plug 804, so that the spring 810 may not escape from the cartridge cylinder 802.

When the core chuck 805 is pushed up by the push rod (not shown), the stick type cosmetic material (not shown) retained by the core chuck is fed out of the tip opening of the cartridge cylinder 802. When the push rod is descended (retracted), the core chuck 805 is pulled down by the pull spring 810 to retract the stick type cosmetic material. When the cartridge 801 is removed from the main body of the container, the push rod comes out of the bore of the cartridge cylinder 802. Thus, the pull spring 810 is allowed to assume a free state and also prevented from escaping from the cartridge cylinder 802 by the plug 804. An advantage of the pull spring type cartridge is that not only the diameter of the cartridge but also the number of parts can be reduced compared with the case where a protection cylinder is disposed around the stick type cosmetic material and further a push spring is provided on the outer surface thereof.

In the cartridge disclosed Japanese Utility Model Publication No. 31232/1991, the pull spring is allowed to assume a free state when the push rod is released from the core chuck. If the cartridge is exposed inadvertently to any external force in this state, the pull spring, the core chuck and the stick type cosmetic material backlash within the cartridge cylinder in the axial and diametrical directions. If such backlash occurs, the soft cosmetic material may be scratched or broken to be unusable or have reduced commercial value. Since the cartridges for the containers for cosmetic materials are in many cases distributed and sold independently of the container or carried independently by users, the cartridges are very liable to be exposed to such risks. In addition, the cartridge of the disclosure requires a plug for preventing the pull spring, the chuck and the stick type cosmetic material from escaping through the rear end opening of the cartridge cylinder.

This invention is directed to provide a cartridge for a container for feeding stick type cosmetic materials, in which not only the number of parts but also the diameter of the cartridge cylinder can be reduced by employing a pull spring, and damage of the stick type cosmetic material can be prevented.

In order to solve the above problems, the cartridge for the stick type cosmetic material feeding container according to this invention is removably attached to the front end of the main body of the container, provided therein with a push rod which can be fed in the axial direction to feed a stick type cosmetic material interlocking with the movement of the push rod, and the cartridge comprises a cylinder having a tip opening through which the stick type cosmetic material is fed in and out; a chuck housed slidably in the cylinder and retaining the stick type cosmetic material, which can be advanced when pushed by the push rod; a pull spring, engaged with the chuck, for urging the chuck toward the rear end of the cylinder; and a chuck stopper for defining the retracted extremity of the chuck provided on the cylinder.

The push rod can be fed out from the main body of the container by means of a screw mechanism and the like. The cartridge is fitted, e.g. by telescopical engagement, to the front end portion of the main body of the container, and the push rod is fed out. Then, the front end portion of the push rod intrudes into the bore of the cartridge, for example, to push the chuck supporting thereon the stick type cosmetic material to allow the stick type cosmetic material to be fed from the tip opening of the cartridge cylinder in accordance with the movement of the push rod. When the stick type cosmetic material is to be retracted into the cartridge, the push rod is retracted into the main body of the container, and thus the chuck and the cosmetic material supported thereon can also be retracted into the cartridge, in accordance with the retraction of the push rod, with the aid of the resilience of the pull spring urging the chuck backward. Since the retracted extremity of the chuck is defined by the chuck stopper provided on the cylinder, it does not happen that the chuck and the pull spring engaged therewith escape from the cylinder even in the absence of the plug.

In the cartridge for a stick type cosmetic material feeding container according to a preferred embodiment of the invention, the chuck can be positioned at the retracted extremity even after the cartridge is removed from the main body of the container, and the pull spring can be maintained under tension when the chuck is assuming such position, by selecting appropriately the length of the pull spring. Since no chuck stopper is provided in the prior art cartridge, the chuck can be retracted being abutted against the push rod so long as the pull spring is under tension, but if the chuck is retracted to such a degree that the pull spring assumes a free state, the chuck is stopped at such position. However, the chuck stopper provided in the cartridge of the invention is allowed to be abutted against the chuck, and thus the chuck can be located at the retracted extremity maintaining the pull spring under tension by selecting suitably the length of the pull spring even when the chuck is abutted against the stoppers.

According to another preferred embodiment of the invention, the cartridge cylinder is provided with a spring tail retaining section on which the rear end portion of the pull spring can be retained so as not to move toward the front end of the cylinder, and the chuck is provided with a spring head retaining section on which the front end portion of the pull spring is retained; the front end and rear end portions of the pull spring having a shape to allow catching thereof by the respective retaining sections.

If the rear end portion of the pull spring is adapted not to move toward the front end of the cylinder, a sufficient tension can be imparted to the pull spring. Of course, the spring may also be adapted not to move toward the rear end of the cylinder. As the means of retaining the spring, the spring wire may be caught by pins, holes or hooks; or may be adhered using an adhesive; or the plastic part may be softened by heating and pushing the spring wire into the thus softened part. However, the mode of retaining the spring is not particularly limited according to this invention. The expression "the front and rear end portions of the pull spring have a shape to allow catching thereof by the respective retaining sections" means that these portions of the pull spring have suitable shapes depending on the above retaining means. Incidentally, "the front end portion of the spring" means the portion of the spring locating near the opening end of the cylinder in the assembly, and should be appreciated to indicate the front end face or strictly the tip end of the spring. The same shall apply to the rear end portion of the spring.

In a preferred embodiment of the invention, a chuck stopper is of a resilient type having an inward projection protruding to the inside of the cylinder and can be flexed outward, when the chuck is to be incorporated into the cylinder through the rear end opening thereof, to allow passage of the chuck, while, after passage of the chuck, the chuck stopper resume the original posture to be abutted against the chuck or pull spring and prevent the chuck from retracting. According to this embodiment, a cartridge which has a simple structure and can be assembled easily can be provided.

The expression "to allow passage of the chuck" does not necessarily means that the entire body of the chuck passes the stopper. If some portion of the chuck is abutted against the stopper to be prevented from retracting any further, the stopper may spring back to the original posture at such position. Meanwhile, in the case where some portion of the pull spring retained on the chuck is to be abutted against the stopper, the pull spring is appreciated to be a part of the chuck, so that the stopper is required to spring back after such portion of the pull spring passed the stopper. The manner that the chuck stopper is abutted against the chuck or pull spring may be directly or indirectly, i.e. the former may directly be abutted against the latter two, or some intermediate member or part may be present between them. Incidentally, such relationship between the members or parts shall be appreciated to apply in the relationships between other members or parts referred to this specification and claims.

According to another preferred embodiment of the invention, the chuck stopper is of a resilient type having an outward projection protruding outward from the cylinder, and the resilient chuck stopper do not protrude to the inside of the cylinder when the chuck is to be incorporated into the cylinder from the rear end opening, while they can be flexed inward, after passage of the chuck, by fitting a stopper pusher on the outer surface of the cylinder and protrude partly into the cylinder. Thus, the chuck or pull spring can be abutted against the thus protruded portion of the chuck stopper to be prevented from retracting. Since the resilient stopper does not protrude into the cylinder in this embodiment, the chuck can easily be incorporated into the cylinder. Further, there is no fear that the stick type cosmetic material is interfered with the inward projection of the stopper and damaged. The expression "passage of the chuck" has the same meaning as described before.

According to another preferred embodiment of the invention, the resilient stopper is formed by slitting partly the cylinder. Since the stopper needs not be formed as independent parts, the production and assembly costs can be reduced.

According to another preferred embodiment of the invention, a projection is formed on the outer surface of the chuck at a certain portion; while a groove is formed on the inner surface of the cylinder in the axial direction in which the projection can be engaged; and the chuck stopper is engaged with this projection to define the retracted extremity of the chuck, the chuck stopper being provided not to protrude beyond the groove.

Since the stopper does not substantially protrude beyond the groove of the cartridge cylinder, detrimental interference between the stopper and the stick type cosmetic material can be prevented. The expression "the stopper does not substantially protrude beyond the groove" means that such a degree of protrusion that the stopper can be retracted by a light touch is permissible in this invention.

According to another preferred embodiment of the invention, the cartridge cylinder is provided at the rear end portion with a rotation-stop section, which is engaged with the rotation-stop member provided on the main body of the container to serve as the rotation-stop mechanism of the push rod.

According to this embodiment, the slitted shaft provided with a rotation-stop section as used in the prior art cartridge is not necessary, leading to reduction in the number of parts and that of the assembly steps. Incidentally, the rotation-stop section may be provided at the rear end portion of the cylinder on any of the inner surface, outer surface and end face. The rotation-stop section may have a form of rib, groove, protrusion or ridge, triangle, square, star, etc.

According to another preferred embodiment of the invention, the chuck is provided at the rear end portion with a rotation-stop section, which is engaged with the rotation-stop section provided at the front end of the push rod to serve as the rotation-stop mechanism of the push rod.

According to this embodiment, the rotation-stop can be secured only by subjecting the push rod and the chuck to necessary working without using extra parts, and thus the number of parts can be reduced.

It should be noted here that the chuck referred to herein means widely retaining members in general so long as they can hold the rear end portion of the stick type cosmetic material and feed it in or out. Meanwhile, the expression "provided" like in "the chuck stopper (A) is provided on the cylinder (B)" or "A provided on B", etc. includes widely such cases where A and B are formed integrally and where A and B are separate bodies and are assembled into one body.

Figure 23A:
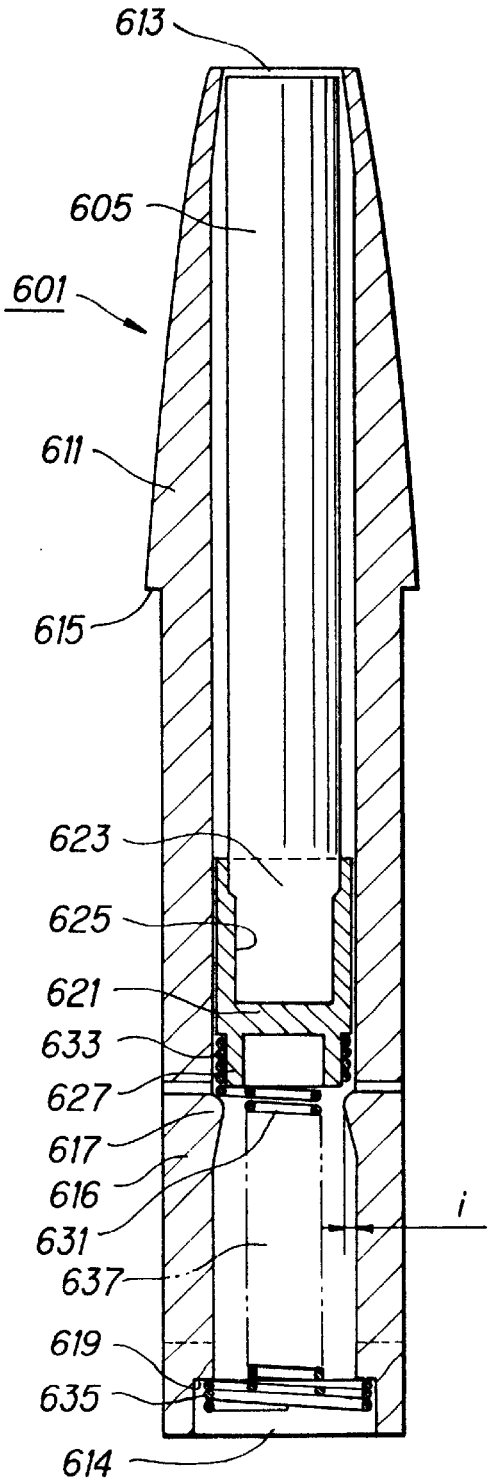
FIG. 23 shows a cartridge for the stick type cosmetic material feeding container according to one embodiment of the invention, with a chuck being retracted to the retracted extremity, in which (A) is a cross-sectional view, and (B) is a side view.

FIG. 23 shows a cartridge for the stick type cosmetic material feeding container according to one embodiment of the invention, with a chuck being retracted to the retracted extremity, in which (A) is a cross-sectional view, and (B) is a side view. A cartridge 601 basically consists of three parts, i.e. a cartridge cylinder 611, a chuck 621 and a pull spring 631. The cartridge cylinder 611 has an elongated cylindrical form with a tip opening 613 at the front end (upper end in FIG. 23) portion and a rear end opening 614 at the rear end (lower end in FIG. 23) portion. The stick type cosmetic material housed in the cartridge 601 is fed in and out through the tip opening 613. The inner diameter of the tip opening 613 is designed to be as large as the outer diameter of the stick type cosmetic material 605 plus a necessary clearance. A spring tail retaining surface 619 (to be detailed later) for retaining thereon the rear end portion of the pull spring 631 is provided at the rear end opening 614. Meanwhile, chuck stoppers 616 (to be detailed later) each having an inward projection 617 are provided at the lower portion of the cylinder.

Figure 23B:
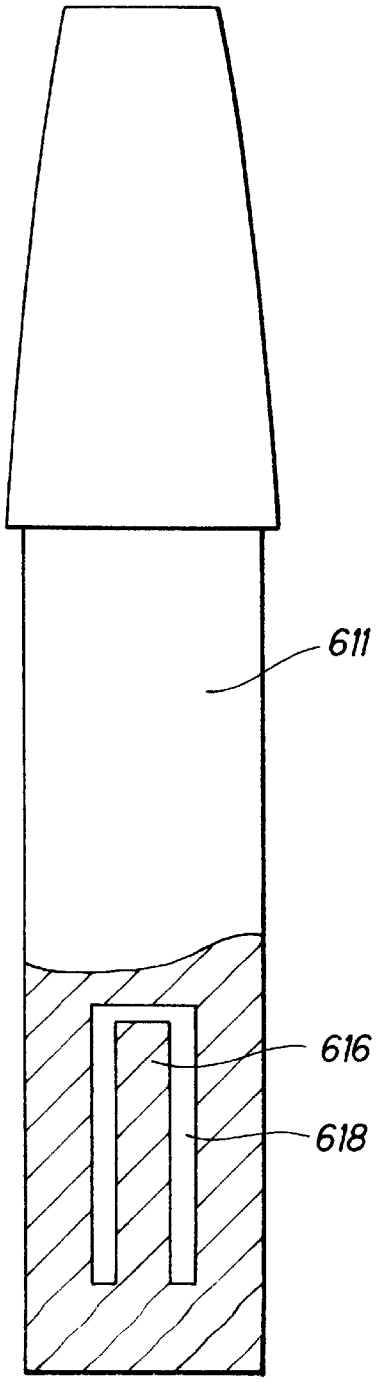
Figure 24A:
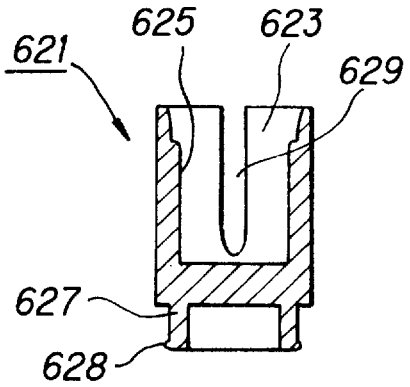
FIG. 24 shows in detail the chuck of the cartridge shown in FIG. 23, in which (A) is a cross-sectional view, and (B) is a side view.
Figure 24B:
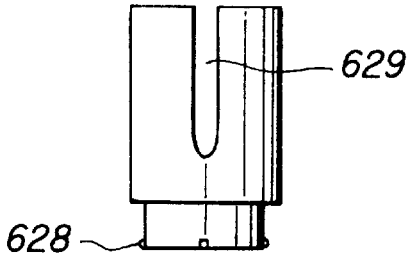

The chuck 621 has a cylindrical form with a closed bottom and is housed in the cartridge cylinder 611 slidably in the axial direction (vertically in FIG. 23). FIG. 24 shows in detail the chuck of the cartridge shown in FIG. 23, in which (A) is a cross-sectional view, and (B) is a side view. The chuck 621 has a substantially U-shaped cross section with a cavity 623 being defined therein, in which the rear end portion of the stick type cosmetic material is inserted and retained. The ribs 625 enhance secured holding of the stick type cosmetic material in the chuck 621. Chuck slits 629 are formed on the lateral wall of the chuck 621, so that the lateral wall may be pulled apart at the slits when the rear end portion of the stick type material is being inserted into the chuck 621 and that the stick type cosmetic material may not readily be broken when an external force is inadvertently applied to the cosmetic material.

An annular spring head retaining section 627 is extended at the bottom of the chuck 621, and spring retaining bosses 628 are provided at the lower edge of said section 627. The front end portion 633 of the pull spring 631 is fitted on the retaining section 627 to allow the spring wire to be caught by the bosses 628, and thus the front end portion of the spring 631 is retained on the chuck 621.

Figure 25:
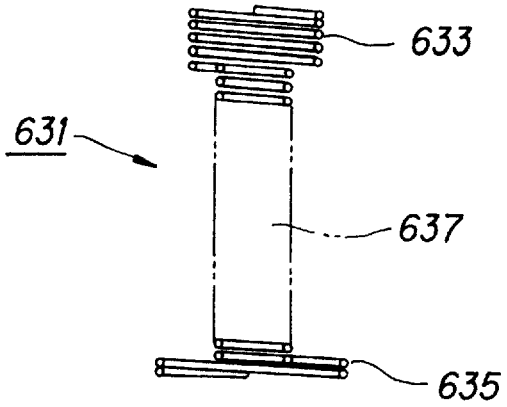
FIG. 25 shows in detail a cross-sectional view of the pull spring of the cartridge shown in FIG. 23.

The pull spring 631 consists of the front end portion 633 which is fitted to the chuck 621, a middle portion 637 having a diameter smaller than that of the front end portion 633, and a rear end portion 635 having a diameter larger than that of the front end portion 633. FIG. 25 shows in detail a cross-sectional view of the pull spring 631 of the cartridge 611 shown in FIG. 23.

The rear end portion 635 of the pull spring 631 is abutted at the upper side thereof against the step-like spring tail retaining surface 619 provided in the rear end opening 614 of the cartridge cylinder 611. The diameter of the rear end opening 614 is designed to be larger than the bore of the cartridge cylinder 611 in which the chuck 621 slides. Thus, the rear end portion 635 of the spring 631 is positioned so as not to move toward the front end of the cartridge cylinder 611 (upward in FIG. 23).

The lower side of the front end portion 633 of the pull spring 631 is abutted against the upper end faces of the inward projections 617 of the chuck stoppers 616, whereby the pull spring 631 and the chuck 621 are adapted not to retract any further (downward in FIG. 23). The upper end face of the inward projection 617 of each stopper 616 may otherwise be abutted against the lower end face of the spring head retaining section 627 of the chuck 621 to prevent retraction of the chuck 621.

The chuck stoppers 616 are formed integrally with the cartridge cylinder 611 in this embodiment. The stopper 616 is, as shown in FIG. 23(B), has a tongue-like shape formed by defining a U-shaped slit on the lateral wall of the cartridge cylinder 611. The upper portion of the stopper 616 is designed to be slightly thicker than the lateral wall of the cartridge cylinder 611, and the inner portion at the upper part of the stopper 616 constitutes the inward projection 617 projecting to the inside of the cartridge cylinder 611. The profile of the inner portion of the stopper 616 is rounded at the upper edge, and the rounded portion projects most inward. A gentle slope is formed from the rounded edge downward and combined with inner surface of the cartridge cylinder having a normal wall thickness.

The tongue-shaped chuck stopper 616 may be flexed at the base thereof if the material and dimensions are suitably selected. When the chuck 621 is to be inserted into the cartridge cylinder 611 through the rear end opening 614 thereof, the inward projections 617 of the stoppers 616 are pushed by the upper end face of the chuck 621 to flex the stoppers 616 outward and retract the inward projections from the cylinder, and thus the chuck 621 can be inserted to the position above the stopper 616. After passage of the chuck 621 over the stopper section, the stoppers 616 spring back due to their resilience to resume the original posture where the inward projections 617 protrude to the inside of the cartridge cylinder 611, and retraction of the chuck can be prevented by allowing the lower surface of the chuck or the lower side of the front end portion 633 of the spring to be abutted against the upper end faces of the inward projections 617.

The cartridge cylinder 611 and the chuck 621 are generally formed by injection molding using a plastic material. The slits 618 on the lateral wall of the cartridge cylinder 611 are formed using U-shaped pins which are inserted from the lateral sides toward the center of the cylinder until they are abutted against the core pin. The inward projections 617 of the stoppers 616 can be formed by casting the plastic material into the cavities formed on the outer surface the core of the mold. When the core is drawn from the mold, the stoppers 616 themselves flex outward to allow the inward projections to retract from the inner surface, so that the inward projections 617 are prevented from being undercut by the core.

These resilient tongues or stoppers may not be limited to the type shown in FIG. 23, where the tongues extend upward, and the tongues may be extended downward or in the horizontal direction (in the direction orthogonal to the axis of the cartridge cylinder). The resilient tongues may not be limited to the rectangular shape and can be a triangular, trapezoidal and parallelogramatic shapes, or such shapes having rounded corners, so long as the intended purpose thereof can be attained and the molding procedures including core pin drawing are not interfered.

FIG. 26 shows an example of the rotation-stop mechanism of the push rod in the stick type cosmetic material feeding container according to this invention, in which (A) is a cross-sectional view of the chuck in the mechanism, (B) is a cross-sectional view of the main body of the container, (C) is a bottom view of the rotation-stop of the chuck and (D) is a cross-sectional view of the rotation-stop section provided at the front end of the push rod. FIG. 27 shows a side view of the chuck according to a variation of the rotation-stop mechanism.

Figure 26A:
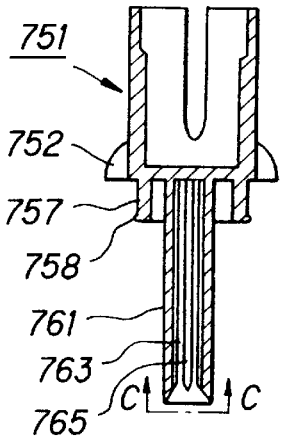
FIG. 26 shows an example of the rotation-stop mechanism of the push rod in the stick type cosmetic material feeding container according to this invention, in which (A) is a cross-sectional view of the chuck in the mechanism, (B) is a cross-sectional view of the main body of the container, (C) is a bottom view of the rotation-stop section of the chuck, and (D) is a cross-sectional view of the rotation-stop section provided at the front end of the push rod.
Figure 26B:
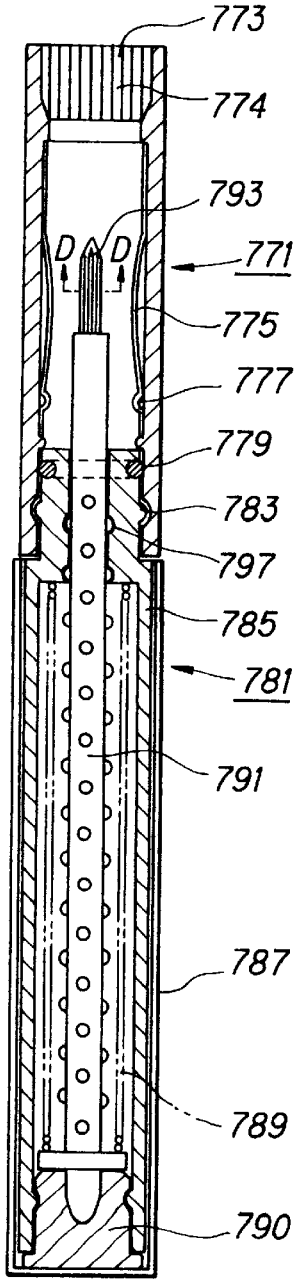
Figure 26C:
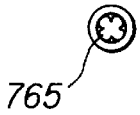
Figure 26D:
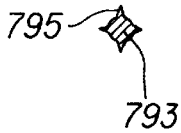
Figure 27:
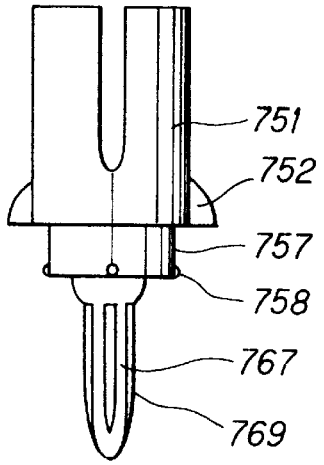
FIG. 27 shows a side view of the chuck according to a variation of the rotation-stop mechanism.

The chuck 751 shown in FIG. 26(A) is provided at the lower end face with a spring head retaining section 757 having spring retaining bosses 758 and also a cylindrical rotation-stop (female) section 761 extending downward. The rotation-stop (female) section 761 has an open bottom, and rotation-stop ribs 765 are formed on the inner surface of said section to extend in the axial direction. The chuck 751 is incorporated into the cartridge slidably in the axial direction being urged backward by a return spring. When the cartridge is inserted to the opening 773 of the holder 771 in the main body 781 of the container, the rotation-stop section 793 provided at the front end of the push rod 791 is fitted in the rotation-stop bore of the chuck 751, wherein the ribs 765 in the bore 763 and the rotation-stop ribs 795 provided at the front end of the push rod are engaged to allow the chuck 751 and the push rod 791 to turn synchronously. The projections 752 provided on the circumference of the chuck 751 are engaged with the grooves formed to extend axially on the inner surface of the cartridge cylinder, so that the chuck 751 and the cartridge cylinder can be turned synchronously. Accordingly, the push rod 791 and the cartridge cylinder are turned synchronously, and thus the push rod 791 can be fed by turning the cartridge and the main body 781 of the container or by turning the main body 781 of the container and the holder 771 which turns synchronously with the cartridge under engagement of the rotation-stop spline 774 of the cartridge relative to each other.

The relationship between the ridge (male) and recess (female) in the rotation-stop mechanisms of the chuck and the push rod may be, as shown in FIG. 27, the rotation-stop section (male) having ribs 769 provided on the circumference of the chuck and the rotation-stop section (female) having holes or grooves provided on the push rod, which are engageable with the ribs 719.

On the inner surface of the holder 771 of the main body 781 of the container in this embodiment, leaf springs 775 with ridges 777 are attached. These leaf springs 775 retain the cartridge inserted into the holder under resilient press contact therewith. The ridges 777 of the leaf springs 775 engage with the annular recess of the cartridge and prevents the cartridge from slipping off. An internal thread section 783 having spiral grooves formed on the inner surface thereof is provided at the upper portion of the inner barrel 785 of the main body 781. Meanwhile, an O-ring 779 is interposed between the outer surface at the upper portion of the inner barrel and the inner surface at the lower portion of the holder to provide an appropriate frictional resistance between the holder and the inner barrel of the container.

A group of protrusions, which engage with the spiral grooves of the internal thread section 783 of the inner barrel 785, are provided in rows on the outer surface of the push rod 791 in this embodiment, and these protrusions are arranged in rows at a predetermined pitch and with predetermined circumferential angles between the rows so as to function spirally as an external thread. These protrusions arranged in linear rows can also be allowed to play a role of rotation-stop ribs as shown in FIG. 9. Thus, the group of protrusions of the push rod can exhibit a plurality of functions depending on the grouping or selection thereof. A push spring 789, which has the same action as the push spring 451 in the main body of the container shown in FIG. 15, is fitted to wind around the push rod 791. A plug 790 is fitted to the end portion of the main body to define the stroke end of the push rod 791 and also prevent the parts in the container from escaping.

Figure 29A:
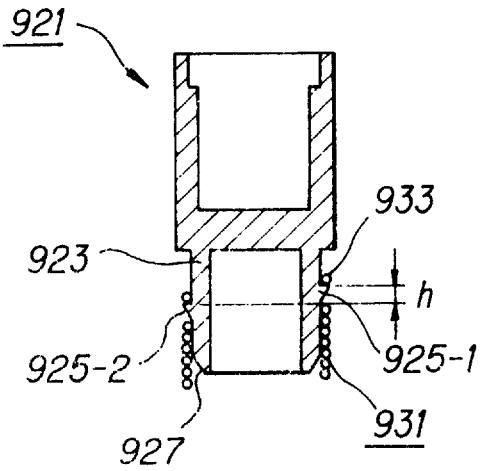
FIG. 29 shows a chuck in the cartridge for the stick type cosmetic material feeding container according to another embodiment of the invention, in which (A) is a cross-sectional view (assembled with the pull spring) and (B) is a side view.
Figure 29B:
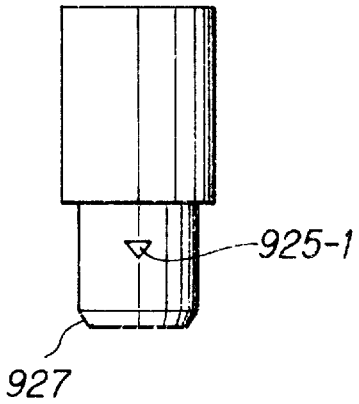

FIG. 29 shows a chuck in the cartridge for the stick type cosmetic material feeding container according to another embodiment of the invention, in which (A) is a cross-sectional view (assembled with the pull spring) and (B) is a side view. The outer surface (circumference) at the lower part of the chuck 921 constitutes a spring head retaining section 923 having two bosses 925-1,925-2 formed thereon on which the pull spring 931 is to be caught. The bosses 925 each have a cross section of a triangle directing upward. The upper face of each boss 925 is substantially perpendicular to the circumference of the spring head retaining section 923. Further, the two bosses 925-1,925-2 are arranged on the circumference of the spring head retaining section 923 with an angle of 180° therebetween in the circumferential direction and with a level difference h in the vertical direction. The boss 935 has a flat triangular shape in a side view of the chuck, as shown in FIG. 29(B).

Figure 30:
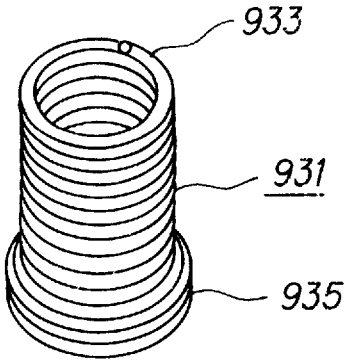
FIG. 30 shows a perspective view of the pull spring shown in FIG. 29.

As shown in FIG. 29(A), the upper end portion of the pull spring 931 is fitted on the circumference of the spring head retaining section 923. FIG. 30 shows a perspective view of the pull spring 931 shown in FIG. 29. The pull spring 931 is a coil spring and has an enlarged diameter portion at the bottom (rear end portion 935). Other portions of the pull spring 931 have the same diameter. The inner diameter of the upper end portion (to be fitted on the chuck) of the pull spring 931 is substantially the same as the outer diameter of the spring head retaining section 923.

The manner how the pull spring 931 shown in FIG. 30 is fitted on the chuck 921 shown in FIG. 29 will now be described. First, the front end portion (upper portion) of the pull spring 931 is pushed a little upward onto the circumference of the spring head retaining section 923. Since a tapered section 927 is provided at the lower edge of the spring head retaining section 923, it allows smooth insertion of the spring. Next, the pull spring 931 is further pushed upward while it is turned in the positive direction (or turning the chuck 921) to press the spring wire 933 at the front end portion of the pull spring 931 against the lower boss 925-2. The spring wire 933 then slips over the boss 925-2, and the spring is pushed further upward to allow the spring wire 933 to slip over the upper boss 925-1. Thus, the pull spring 931 can be assembled with the chuck 921, as shown in FIG. 29(A).

The level difference h between the upper boss 925-1 and the lower boss 925-2 is ½ to 2 times the pitch of the spring, and these bosses 925 are preferably provided conforming to the winding direction of the spring, so as to facilitate rotational fitting of the spring. Further, the spring wire 933 is allowed to locate between the two bosses 925-1,925-1, and thus it does not happen that the spring wire and the bosses overlap each other. Therefore, the pull spring 931 can be fitted well on the circumference of the chuck to allow smoother movement of the chuck in the cartridge cylinder.

Figure 31:
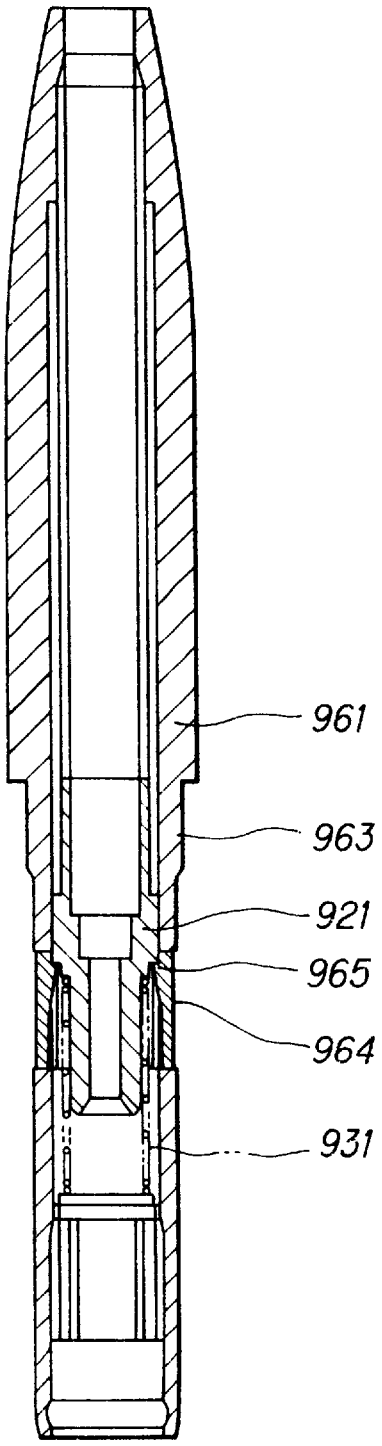
FIG. 31 shows a cartridge for the stick type cosmetic material feeding container according to another embodiment of the invention.
Figure 32A:
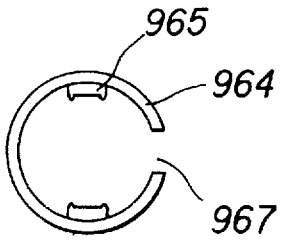
FIG. 32 shows a stopper in the cartridge shown in FIG. 31, in which (A) is a front view, and (B) is a cross-sectional side view.
Figure 32B:
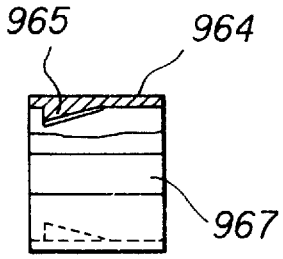
Figure 33:
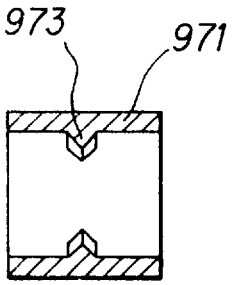
FIG. 33 shows a cross-sectional side view of a variation of the stopper.

FIG. 31 shows a cartridge for the stick type cosmetic material feeding container according to another embodiment of the invention. FIG. 32 shows a stopper in the cartridge shown in FIG. 31, in which (A) is a front view, and (B) is a cross-sectional side view. Meanwhile, FIG. 33 shows in cross-sectional side view a variation of the stopper.

The characteristic of the cartridge shown in FIG. 31 is that the stopper member 964 is not formed integrally with the cartridge cylinder 961 but as an independent part. As shown in FIG. 32, the stopper member 964 has a C-shaped horizontal cross section, so that it can elastically be deformed by pulling apart the edges of the slit 967.

Inward projections 965 protrude inward from the inner surface of the stopper member 964 to oppose to each other with an angle of 180° therebetween. These inward projections 965, against which the chuck is abutted, serve as the chuck stoppers. The positions and shape of the inward projections 965 may be symmetric, as shown in FIG. 33. In this case, since the chuck has not top and bottom, it can be incorporated into the cartridge cylinder in either axial direction.

Meanwhile, holes (openings having a diameter to allow protrusion of the inward projections 965 therethrough into the cylinder bore) are defined at that portion of the cartridge cylinder 961 where the cross section of the stopper member 964 is depicted. That portion of the cylinder 961 around the holes is recessed along the outer circumference. FIG. 31 shows a state where the stopper member 964 is fitted in the recess of the cartridge cylinder by pulling apart (elastically deforming) the edges of the slit of the stopper member 964. In such embodiment, since no slit and the like is exposed on the outer surface of the cartridge cylinder, the cartridge advantageously has a good appearance, although the stopper must be provided as an independent part.

As apparent from the above description, the cartridges for the stick type cosmetic material feeding containers typified by the embodiments shown in FIGS. 23 to 33 can exhibit the following effects.

(1) The cartridge of the invention can be composed of at least three parts (i.e. cylinder, chuck and pull spring), like in the embodiment of FIG. 23, and the plug or other means for preventing escape of the spring as used in the prior art cartridge are unnecessary, so that the production and assembly costs can be reduced;

(2) Since the pull spring for urging the chuck backward can be maintained under tension even after the cartridge is removed from the main body of the container, the liability that the chuck backlashes in the axial and radial directions of the cartridge cylinder can be minimized; i.e. the core material can always be maintained upright (cocentered with the axis of the cylinder), thus preventing damage of the stick type cosmetic material supported by the chuck; and (3) While, in the case where a push spring is fitted around the stick type cosmetic material, a cylinder for protecting the stick type cosmetic material becomes necessary, and thus the diameter of the push spring must be greater than the outer diameter of the stick type cosmetic material and further that of the protecting cylinder; the diameter of the pull spring according to this invention can substantially be the same as or smaller than the outer diameter of the stick type cosmetic material. Thus, the outer diameter of the cartridge can eventually be made smaller.

By the way, the cartridge shown in FIG. 23 somewhat suffers problems in designing and manufacturing. Since the cartridge must be formed by injection molding using a plastic material, the degree of projection (i in FIG. 23) of the inward projections 617 cannot be made so great. For example, if the plastic cartridge 611 has an inner diameter of 5 mm, the maximum degree of projection i is generally 0.1 to 0.2 mm. Accordingly, it may happen, although not very often, that the core chuck 621 runs over the inward projections 617 of the stoppers and slip out of the cylinder 611 when the core chuck 621 is rushed backward from the front end side of the cartridge cylinder 611 being urged by the pull spring 631. Such backward rushing of the core chuck occurs, for example, when the cartridge is drawn speedily out of the main body of the container with the core chuck being advanced to the front end side of the cartridge cylinder.

This invention is directed to provide a cartridge for the container for feeding stick type cosmetic material which employes effectively a pull spring and chuck stoppers to successfully achieve reduction in the diameter of the cartridge and the number of parts or prevention of the damage of stick type cosmetic materials in the cartridge, and particularly one which can effectively prevent the core chuck from escaping from the cartridge cylinder.

While this invention is proposed so as to provide such cartridge, the main idea "to define the retracted extremity of the core chuck by the combination of the resilient piece of the core chuck and the chuck stopper" is useful not only in the combination with the pull spring but also in various other embodiments. Therefore, this invention provides a variety of cartridges for the container for feeding stick type cosmetic materials, in which the diameter of the cartridge and the number of parts can be reduced.

In order to attain the above objects, the cartridge for the container for feeding a stick type cosmetic material according to this invention can removably be attached to the front end of the main body of the container, provided therein with a push rod which can be fed in the axial direction to feed a stick type cosmetic material in accordance with the movement thereof, and the cartridge comprises a cylinder having a tip opening through which the stick type cosmetic material is fed in and out and a core chuck housed slidably in the cylinder and retaining the stick type cosmetic material, which can be advanced toward the front end of the cylinder when pushed by the push rod; wherein the cylinder is provided with a chuck stopper for defining the retracted extremity of the core chuck, and the core chuck is provided with a resilient piece, which overhangs outward from the core chuck, to be engaged with the chuck stopper.

The push rod can be fed out of the main body of the container by means of a screw mechanism and the like. The cartridge is fitted, e.g. by telescopical engagement, to the front end portion of the main body of the container, and the push rod is fed out. Then, the front end portion of the push rod intrudes into the bore of the cartridge cylinder to push the core chuck supporting thereon the stick type cosmetic material to allow the stick type cosmetic material to be fed from the tip opening of the cartridge cylinder in accordance with the movement of the push rod. When the stick type cosmetic material is to be retracted into the cartridge, the push rod is retracted into the main body of the container, and thus the chuck and the cosmetic material supported thereon can also be retracted into the cartridge in accordance with the retraction of the push rod with the aid of the resilience of the return spring urging the chuck backward or of the force applied by the finger of the user. Since the retracted extremity of the chuck is defined by the chuck stopper provided on the cylinder, it does not happen that the chuck and the pull spring engaged therewith escape from the cylinder even in the absence of the plug and the like.

In the cartridge according to this invention, the resilient piece of the core chuck overhangs outward from the outer surface thereof to be engaged with the chuck stopper, and thus the retracted extremity of the core chuck can be defined. Since the resilient piece of the core chuck is formed outer than the outer circumference thereof, the resilient piece can be flexed at a great level of bending dimension compared with the resilient chuck stopper of FIG. 23. Besides, a greater degree of interference between the resilient pieces and the chuck stoppers can also be secured. Further, the abutting section of the resilient piece need not have slippery rounded edge. Accordingly, such an accident that the core chuck escape from the cartridge cylinder can be prevented even when the core chuck impinge upon the stopper.

In a preferred embodiment of the invention, the chuck stopper has an inward projection protruding inward from the inner surface of the cylinder, and the resilient piece of the core chuck flexes inward to allow passage of the core chuck over the inward projection, while, after passage of the core chuck, the resilient piece resumes the original posture to be abutted against the inward projection of the chuck stopper and prevents the core chuck from retracting. According to this embodiment, the engagement between the resilient piece and the chuck stopper can further be ensured.

The manner that the stopper is abutted against the resilient piece of the core chuck may be direct or indirect with a certain intermediate member or piece being interposed therebetween. It should be appreciated, that such relationship between any two parts (possibility of the presence of intermediate parts) apply to the relationships between other parts described herein.

Further, the chuck stopper itself may also be allowed to have a resilient structure. Namely, the chuck stopper may be allowed to flex outward when the core chuck is incorporated into the cartridge cylinder, and after completion of incorporation, the chuck stopper springs back to resume the original posture and protrude inward into the bore of the cartridge cylinder. In such embodiment, a greater level of interference between the resilient piece of the core chuck and the chuck stopper can be secured, and thus the core chuck is prevented from escaping from the cylinder more effectively. Meanwhile, such resilient stopper can be formed by forming a slit on the wall of the cartridge cylinder. In this case, the stopper need not be prepared as independent parts, the production and assembly costs can be reduced.

In another preferred embodiment of the invention, the resilient piece of the core chuck overhangs outward therefrom, while a groove in which the resilient piece can be engaged is formed on the inner surface of the cylinder to extend in the axial direction. Thus, the core chuck is prevented from rotating in the cartridge cylinder, contributing to the prevention of damage of the stick type cosmetic material or distortion of the pull spring.

According to this invention, a pull spring, which is engaged with the core chuck, for urging the core chuck toward the rear end of the cylinder is preferably disposed additionally to allow the core chuck to be positioned at the retracted extremity even after the cartridge is removed from the main body of the container; and thus the pull spring being maintained under tension, when the chuck is assuming such position, by selecting appropriately the length of the pull spring.

In another preferred embodiment of the invention, an enlarged diameter portion is provided at the rear end portion of the pull spring, whereas the cartridge cylinder is provided with a spring tail retaining surface on which the large diameter portion of the spring is abutted at the end face so as not to move toward the front end of the cartridge cylinder. Meanwhile, bosses for catching the spring wire at the front end portion of the pull spring thereon are provided on the core chuck. In such embodiment, the pull spring can securely be retained between the cartridge cylinder and the core chuck in a simple manner. Incidentally, the shape of the pull spring and the manner of engagement between the core chuck and the cartridge cylinder may not be limited to the embodiment described herein, and other means may be employed. For example, the pull spring of the shape and the manner of engagement disclosed in Japanese Utility Mode Publication No. 31232/1991 may be applied to the cartridge of the invention.

Figure 34:
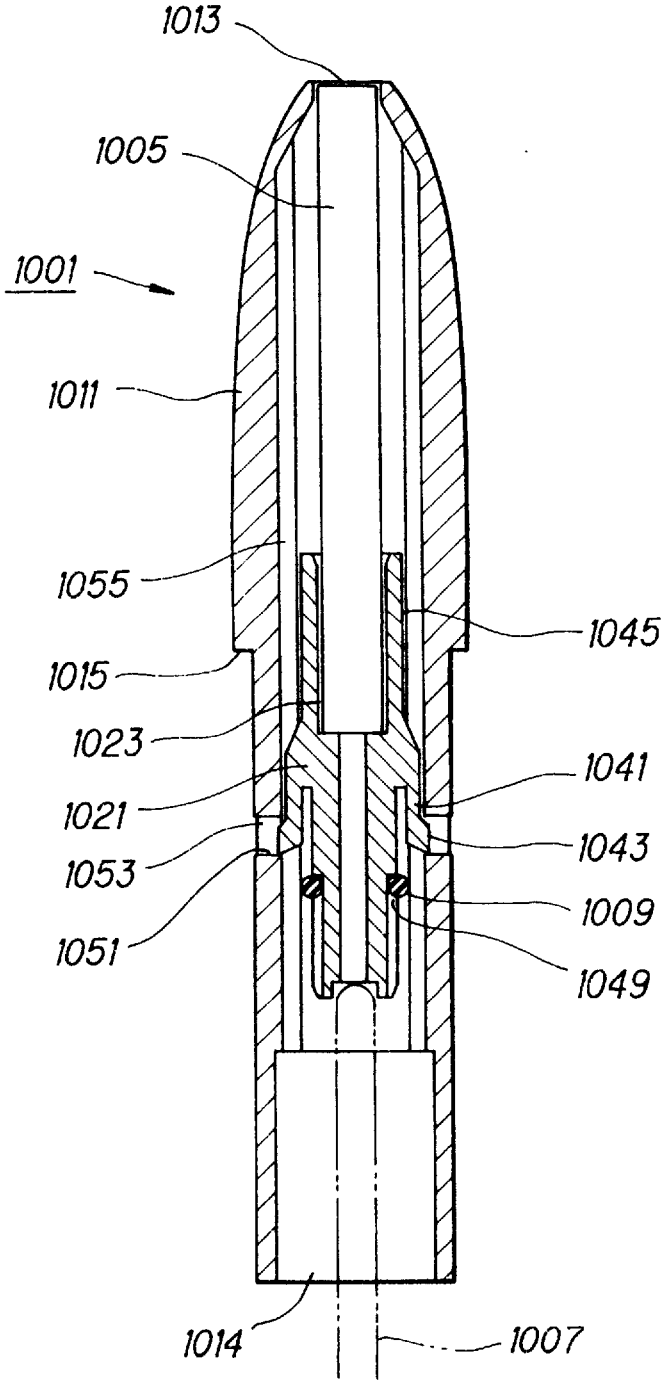
FIG. 34 shows a cross-sectional view of the cartridge for the stick type cosmetic material feeding container according to one embodiment of the invention.

FIG. 34 shows a cross-sectional view of the cartridge for the stick type cosmetic material feeding container according to another embodiment of the invention. The cartridge 1001 is of so-called one-way type having no urging mechanism for returning the stick type cosmetic material 1005 and core chuck 1021. The cartridge of this embodiment consists of two parts, i.e. a cylinder 1011 and the core chuck 1021. A couple of resilient pieces 1041 overhang from the outer surface of the core chuck 1021. The lower end portion of each resilient piece 1041 further projects outward to constitute an abutting section 1043 which is abutted against the edge of the corresponding chuck stopper 1051 of the cartridge cylinder 1011 and define the retracted extremity of the core chuck.

The chuck stoppers 1051 of the cartridge cylinder 1011 shown in FIG. 34 are merely the lower edges of rectangular openings 1053. The abutting section 1043 of each resilient piece 1041 is designed to have a size such that it can be fitted in this opening 1053 when it is assuming its natural posture where the resilient piece 1041 is not pushed inward. When the core chuck 1021 is pushed up (advanced) by a push rod 1007, the resilient piece 1041 is flexed inward to retract the abutting section 1043 from the opening 1053 and ascends. Incidentally, the resilient piece 1041 slides in the grooves 1055 defined on the inner surface of the cylinder 1011 in the axial direction. The profile of the abutting section 1043 of the resilient piece 1041 is slanted down outward at the upper side, so that said section 1043 can smoothly slide into the grooves 1055 of the cylinder 1011 when pushed by the push rod. On the other hand, the lower edge of the abutting section 1043 is allowed to have a rather acute angle, so that it may not easily be squeezed inward when abutted against the chuck stoppers 1051.

The upper part of the core chuck 1021 having a cavity 1023 being defined therein (in which the rear end portion of the stick type cosmetic material 1005 is inserted) has a smooth cylindrical outer surface 1045. The cylindrical outer surface 1045 slides in the bore of the cylinder 1011. The resilient pieces 1041 of the core chuck 1021 constantly press against the troughs of the grooves 1055 radially outward. An O-ring is fitted in the O-ring groove defined on the lower outer circumference of the core chuck 1021 and provides an appropriate sliding resistance between the core chuck 1021 and the cartridge cylinder 1011. Accordingly, the presence of such O-ring ensures smooth sliding motion of the core chuck 1021 in the cylinder 1011. Incidentally, when the stick type cosmetic material 1005 fed out is to be retracted, the tip of the stick type cosmetic material 1005 may be pushed with a finger and the like.

Figure 35A:
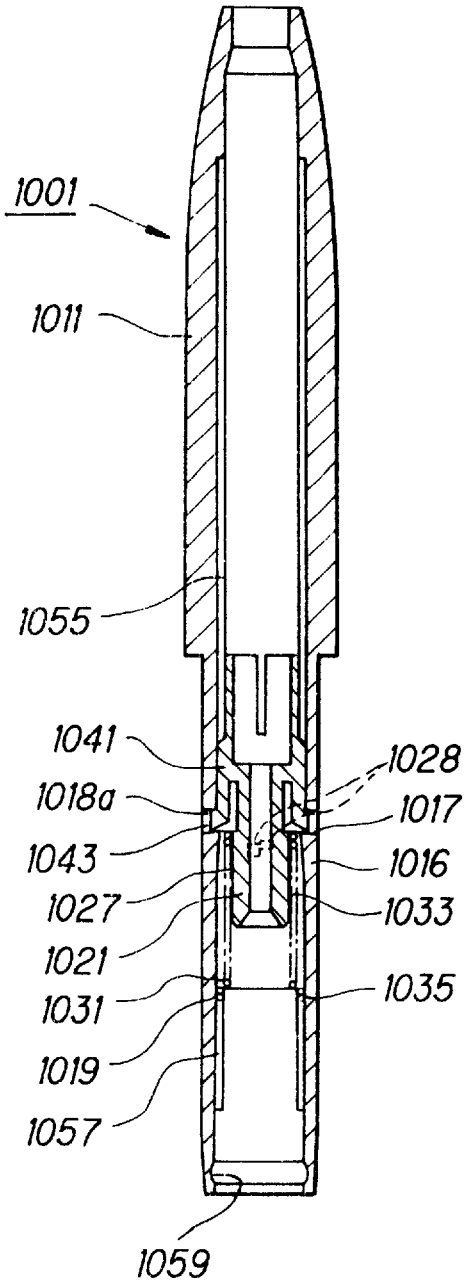
FIG. 35 shows a cross-sectional view of the cartridge for the stick type cosmetic material feeding container according to another embodiment of the invention, in which (A) is a cross-sectional view, and (B) is a side view.

FIG. 35 shows a cartridge for the stick type cosmetic material feeding container according to another embodiment of the invention, in which (A) is a cross-sectional view and (B) is a side view. FIG. 36 shows a core chuck incorporated in the cartridge shown in FIG. 35, in which 36(A) is a cross-sectional view as viewed from the same direction as in FIG. 35(A), 36(B) is a cross-sectional view as viewed from the direction orthogonal to that in FIG. 36(A) and 36(C) is a bottom view. The cartridge 1001 according to this embodiment consists of three parts, i.e. a cylinder 1011, a core chuck 1021 and a pull spring 1031. The characteristics of the cartridge of this embodiment is that a pull spring 1031 for urging the core chuck 1021 backward is provided and that the chuck stoppers 1016 are of a resilient structure each having an inward projection 1017.

Figure 35B:
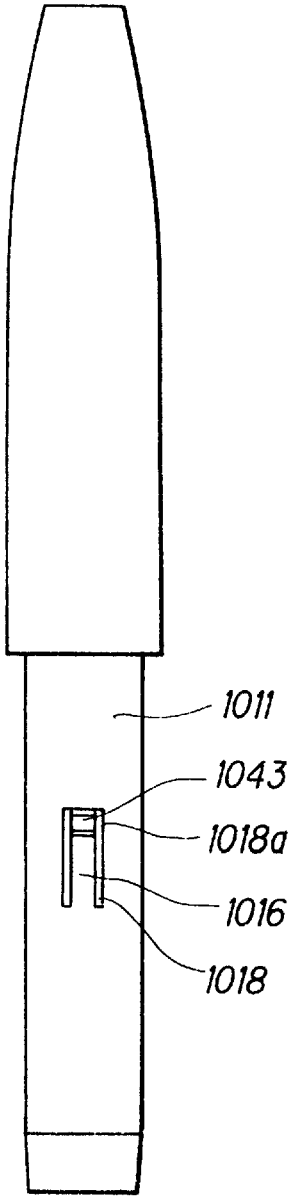
Figure 36A:
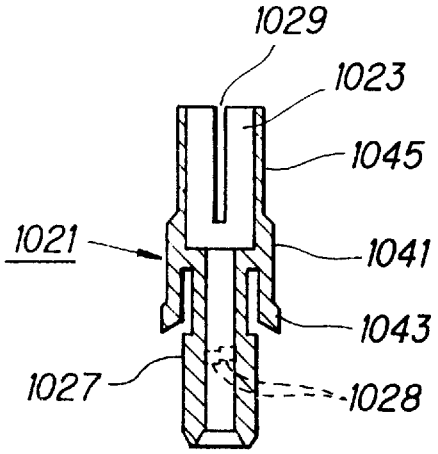
FIG. 36 shows a core chuck incorporated in the cartridge shown in FIG. 35, in which 36(A) is a cross-sectional view as viewed from the same direction as in FIG. 35(A), 36(B) is a cross-sectional view as viewed from the direction orthogonal to FIG. 36(A), and 36(C) is a bottom view.
Figure 36B:
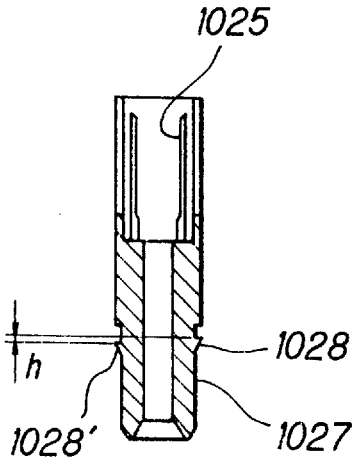
Figure 36C:
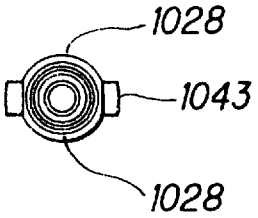

The chuck stoppers 1016 in the cartridge 1001 shown in FIG. 35 are defined in the same manner as the chuck stoppers 616 of the cartridge shown in FIG. 23. More specifically, U-shaped slits 1018 are formed on the lateral side of the cylinder 1011, as shown in FIG. 35(B) to provide tongue-like resilient chuck stoppers 1016. The upper end portion of each chuck stopper 1016 projects slightly inward to constitute an inward projection 1017, as shown in FIG. 35(A). Meanwhile, the abutting section 1043 of each resilient piece 1041 of the core chuck 1021 protrudes into the upper space 1018*a* of the slit 1018 due to its resilience. Accordingly, the level of interference between the abutting section 1043 and the inward protrusion 1017 of the chuck stopper amounts to the sum of the protruding length of the abutting section 1043 and the internally projecting length of the inward projection 1017 of the chuck stopper 1016, so that a great level of interference can be secured compared with the case where the resilient pieces 1041 of the core chuck 1021 are singly employed. Thus, slipping off of the core chuck 1021 can more securely be prevented.

The pull spring 1031 of the cartridge 1001 of the embodiment shown in FIG. 35 is a coil spring. The rear end portion 1035 at the lower end portion of the pull spring 1031 has a diameter larger than the rest of the portions and is abutted against the spring tail retaining surface 1019 provided on the lower inner surface of the cartridge cylinder 1011. Thus, the rear end portion 1035 of the pull spring 1031 is retained not to move toward the front end of the cylinder 1011. The front end portion 1033 at the upper portion of the pull spring 1031 is caught by the bosses 1028 formed on the spring head retaining section 1027 provided at the lower part of the core chuck 1021 and connected therewith.

The shape of the core chuck shown in FIG. 36 will now be described in detail. The bore defined at the upper part of the core chuck 1021 constitutes a cavity 1023 in which the rear end portion of a stick type cosmetic material is inserted. Core chuck slits 1029 and ribs 1025 are formed on the wall of the cavity 1023. The role of these sections are the same as those described with respect to the cartridge of FIG. 23. The cylindrical outer surface 1045 of the core chuck 1021 slides on the inner surface of the cylinder 1011.

Resilient pieces 1041 overhang outward from the cylindrical outer surface 1045 of the core chuck 1021 at the lower end portion thereof. The resilient pieces 1041 each hang like a cantilever so as to be able to easily flex outward. The lower end portion of each resilient piece 1041 projects further outward to constitute an abutting section 1043. The shape and role of the abutting section 1043 are as described above. The resilient pieces 1041 of the core chuck 1021 in this embodiment can be formed, in the posture as shown in FIG. 36(A), by injection molding using a split die and a core pin.

The lower half of the core chuck 1021 also has a cylindrical form, and the outer surface of the cylindrical portion constitutes a spring head retaining section 1027. The spring head retaining section 1027 has a diameter substantially the same as (slightly smaller than) the inner diameter of the pull spring 1031 (coil spring) with a couple of bosses 1028,1028', by which the pull spring 1031 is caught, being provided on the cylindrical outer surface. The details of the core chuck and pull spring are the same as those shown in FIGS. 29 and 30.

Rib-like elongated ridges 1057 are formed on the inner surface, at the rear end portion, of the cartridge cylinder 1011 of the embodiment shown in FIG. 35. These elongated ridges 1057 engage with the synchronously engageable ribs 415 provided on the outer surface of the internal thread member 411 of the main body 400 of the container shown in FIG. 15 etc. and serve to feed the push rod 441. Incidentally, the in-and-out relationship between these engagement sections 1057,415 may be reversed. Further, the shape of these engagement sections is not limited to ribs, and any other shapes including protrusions, a combination of non-annular ridge and recess, etc. can be employed so long as they play a role of rotation-stop mechanism. In the main body of the container shown in FIG. 15, the relationship between the internal thread member 411 and the rotation-stop section 421 may be reversed. Namely, the cartridge may be adapted to engage with the rotation-stop member. As a variation of such engagement, the rotation-stop sections may be provided at the rear end portion of the core chuck and at the front end portion of the push rod.

An annular groove 1059 is formed below the elongated ridges 1057. The annular groove 1059 is engaged with the protrusions 427 or an annular ridge provided on the main body of the container shown in FIG. 15 etc. to serve as a slip stopper for the cartridge. Incidentally, the outer lower end portion of the cartridge cylinder 1011 corresponding to the position where the annular groove 1059 is defined is tapered. The role of this taper is to prevent the lower end portion of the cylinder from expanding and interfering with the inner surface of the main body of the container when the annular groove is engaged with the ridges and the like of the main body of the container.

As apparent from the above description, the cartridges for the stick type cosmetic material feeding containers, typified by the embodiments shown in FIGS. 34 and 35, exhibit the following effects:

(1) The cartridge of the invention can be composed of at least two parts (cylinder and core chuck), as in the embodiment shown in FIG. 34. Even in the embodiment, as shown in FIG. 35, additionally employing a pull spring for spontaneous resetting of the core chuck, the cartridge can be composed of three parts. The plugs or other means for preventing escape of the core chuck or pull spring, as used in the prior art embodiments, are not necessary, and thus the production and assembly costs can be reduced;

(2) Since the level that the resilient pieces of the core chuck is flexed and the shape of the abutting section can be designed relatively freely, such an accident that the core chuck slips over the chuck stoppers to escape from the cartridge even when the core chuck rushes backward (e.g. as pulled by the pull spring) can be prevented; and (3) Since the pull spring for urging the core chuck backward can be maintained under tension even after the cartridge is removed from the main body of the container, the core chuck is further inhibited to backlash in the axial and radial directions. Namely, the core material is constantly maintained upright or cocentered with the axis of the cartridge cylinder, the stick type cosmetic material retained in the core chuck can be prevented from being damaged in the cartridge.

Figure 37:
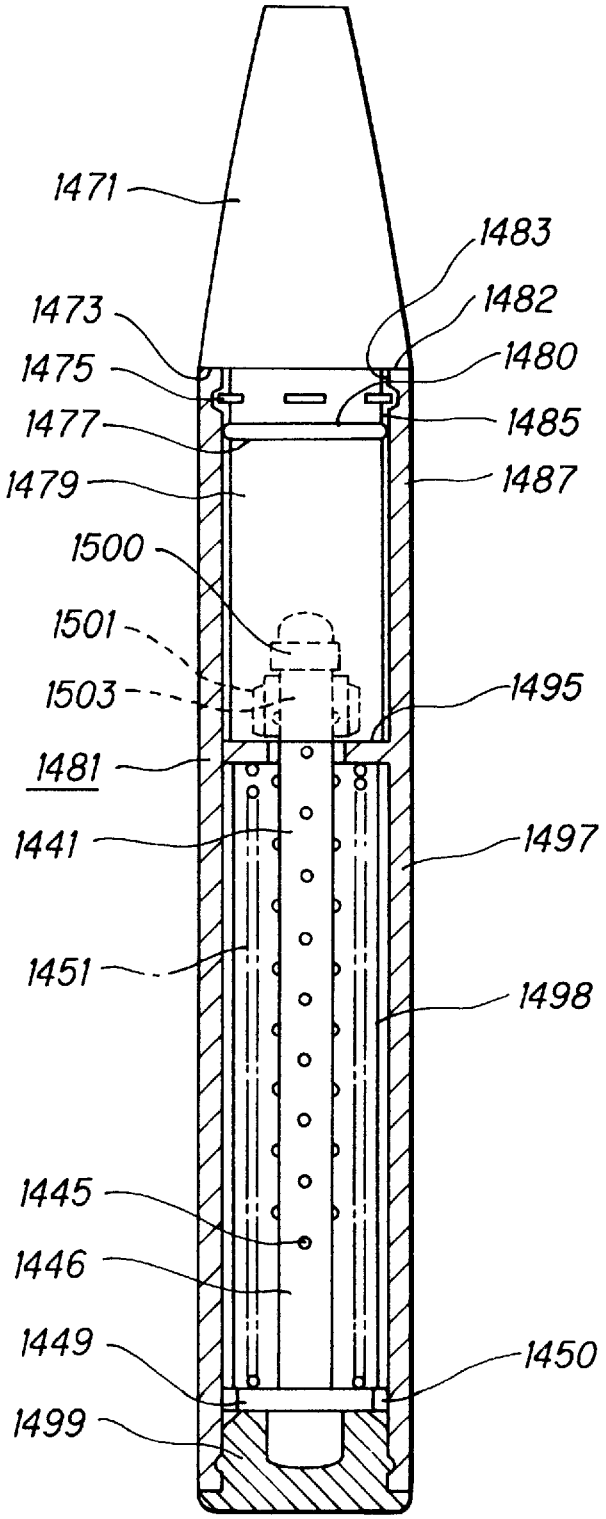
FIG. 37 shows partly in cross-sectional view the container for feeding a stick type cosmetic material according to another embodiment of the invention.

FIG. 37 shows partly in cross-sectional view the container for feeding a stick type cosmetic material according to another embodiment of the invention. This container is of a type in which the features of the container of FIG. 18 and FIG. 21 are combined into one. Specifically, the slip stopper ring 1500 for the internal thread member 1501 of FIG. 37 corresponds to the slip stopper ring 410 of FIG. 21, the vertical grooves 1498 of FIG. 37 corresponds to the vertical grooves 552 of FIG. 21, the butts 1450 of FIG. 37 corresponds to the butts 577 of FIG. 21, and, the flat portion 1446 of FIG. 37 corresponds to the flat portion 446 of FIG. 21. These respective parts or portions act similarly. Incidentally, other parts or portions (not mentioned above) of the container shown in FIG. 37 which are denoted with the same numbers as those in FIG. 18 act similarly with those of the container of FIG. 18.

The characteristic feature of the container of FIG. 37 resides in that the rotation-stop portion 1491 of the container shown in FIG. 18 is not present. In place of the rotation-stop portion, the butts 1450 at the rear end of the push rod 1441 engages with the vertical grooves 1498 provided on the inner face of the lower barrel 1497, thus providing synchronous rotation of the push rod 1441 and the main body 1481. Accordingly, the engagement relation between protrusions 1445 and rotation-stop grooves (1423 in FIG. 18) may not be considered for designing the container. For example, the length of the flat portion 1446 of the push rod 1441 may be enough where the length is longer than the total length of the internal thread member 1501 and the partition 1495 (a thin plate). Therefore, the length of the push rod 1441, finally the length of the main body 1481 can be shortened in the container shown in FIG. 37 as compared with that of the container shown in FIG. 18.

What is claimed is:

1. A cartridge for a stick type cosmetic material feeding container in which the container has a main body having a front end and the cartridge is removably attached to the front end of the main body of the container, the container having a push rod which is moveable in an axial direction to feed a stick type cosmetic material in accordance with the axial movement of the push rod, said cartridge comprising:

a cylindrical body having one longitudinal end provided with a tip opening through which said cosmetic material is fed in and out of said cylindrical body;

a sliding chuck slidably disposed in said cylindrical body, said sliding chuck retaining said cosmetic material such that said cosmetic material is advanced in one direction toward said one longitudinal end of said cylindrical body when pushed by said push rod;

a pull spring engaging said sliding chuck and urging retraction of said sliding chuck in an opposite direction toward the other longitudinal end of said cylindrical body;

a spring retaining section on said cylindrical body engaging one end portion of said pull spring; and a chuck stopper formed integrally and resiliently with said cylindrical body defining the fully retracted position of said sliding chuck in said cylindrical body.

2. A cartridge according to claim 1 wherein said spring retaining section is a first spring retaining section, said pull spring having one end portion engaging said first retaining section so as to preclude movement of said one end portion of said pull spring toward said one longitudinal end of said cylindrical body, said chuck having a second spring retaining section, said pull spring having another end portion engaging said second spring retaining section, said one and said another end portions of said pull spring being configured to be retained by said respective first and second spring retaining sections.

3. A cartridge according to claim 1 wherein said spring engages said cylindrical body so that the chuck is biasingly maintained in its fully retracted position by said spring when said cartridge is removed from said front end of said main body of said container.

* * * * *